US009777729B2

(12) United States Patent
Juan et al.

(10) Patent No.: US 9,777,729 B2
(45) Date of Patent: Oct. 3, 2017

(54) DUAL AXIS ROTOR

(71) Applicant: Exponential Technologies, Inc., Calgary (CA)

(72) Inventors: Alejandro Juan, Calgary (CA); Curtis Patterson, Calgary (CA); Erik Farrell, Calgary (CA); Stephen F. Scott, Calgary (CA); Kyle Fiolka, Calgary (CA)

(73) Assignee: Exponential Technologies, Inc., Calgary (CA)

( * ) Notice: Subject to any disclaimer, the term of this patent is extended or adjusted under 35 U.S.C. 154(b) by 692 days.

(21) Appl. No.: 13/840,514

(22) Filed: Mar. 15, 2013

(65) Prior Publication Data

US 2014/0271301 A1 Sep. 18, 2014

(51) Int. Cl.

| | |
|---|---|
| ***F04C 3/08*** | (2006.01) |
| ***F04C 13/00*** | (2006.01) |
| ***F04C 15/00*** | (2006.01) |

(52) U.S. Cl.

CPC ..... *F04C 3/08* (2013.01); *F04C 13/001* (2013.01); *F04C 15/0061* (2013.01); *F04C 2240/10* (2013.01); *F04C 2240/20* (2013.01)

(58) Field of Classification Search

CPC F04C 13/001; F04C 15/0061; F04C 2240/10; F04C 2240/20; F04C 3/08; F01C 3/08

USPC ..... 418/49, 195

See application file for complete search history.

(56) References Cited

U.S. PATENT DOCUMENTS

| | | | |
|---|---|---|---|
| 32,372 | A | 5/1861 | Jones et al. |
| 351,129 | A | 10/1886 | Salomo |
| 414,642 | A | 11/1889 | Herrick |
| 764,465 | A | 7/1904 | Hendricks |
| 2,101,428 | A | 5/1935 | Cuny |
| 2,101,051 | A | 7/1935 | Cuny |
| 2,242,058 | A | 11/1937 | Cuny |
| 3,101,700 | A | 8/1963 | Bowdish |
| 3,156,222 | A | 11/1964 | Miller, Jr. |
| 3,464,361 | A | 9/1969 | Voser |
| 3,492,974 | A | 2/1970 | Kreimeyer |
| 3,816,038 | A | 6/1974 | Berry |
| 3,895,610 | A | 7/1975 | Wahl |

(Continued)

FOREIGN PATENT DOCUMENTS

| | | |
|---|---|---|
| CA | 2069607 | 11/1993 |
| DE | 1551081 | 4/1970 |

(Continued)

*Primary Examiner* — Mark Laurenzi
*Assistant Examiner* — Paul Thiede
(74) *Attorney, Agent, or Firm* — Schacht Law Office, Inc.; Dwayne Rogge

(57) ABSTRACT

This disclosure concerns an advanced nutating positive displacement device having a high power to mass ratio and low production cost. This device in one example forms an exemplary pump as will be discussed in detail. The examples disclosed herein are of the rotary positive displacement type, but in a class by themselves. The devices are formed by a nutating rotor having a face comprising lobes and valleys, and a fixed stator also having a face with lobes and valleys. The face of the rotor opposes and cooperates with the face of the stator. The opposing faces define chambers that change volume with rotation of the rotor.

38 Claims, 31 Drawing Sheets

(56) References Cited

U.S. PATENT DOCUMENTS

| | | | | |
|---|---|---|---|---|
| 4,229,150 | A | 10/1980 | Teague, Jr. et al. | |
| 4,252,511 | A | 2/1981 | Bowdish | |
| 5,251,594 | A | 10/1993 | Meyer | |
| 5,336,067 | A | 8/1994 | Lim | |
| 5,755,196 | A | 5/1998 | Klassen | |
| 6,494,698 | B2 | 12/2002 | Arnold | |
| 6,506,012 | B2 | 1/2003 | Tuck, Jr. | |
| 6,595,763 | B2 | 7/2003 | Wagner et al. | |
| 6,634,873 | B2 | 10/2003 | Klassen | |
| 6,688,867 | B2 | 2/2004 | Suman et al. | |
| 6,923,055 | B2 | 8/2005 | Klassen | |
| 7,270,106 | B2 | 9/2007 | Stark | |
| 7,726,960 | B2 | 6/2010 | Oui et al. | |
| 7,837,451 | B2 | 11/2010 | Wiedenhoefer et al. | |
| 2010/0074786 | A1 | 3/2010 | Juan et al. | |
| 2012/0269669 | A1 | 10/2012 | Patterson et al. | |
| 2013/0028769 | A1* | 1/2013 | Gekht ..... | F02B 55/02 418/1 |

FOREIGN PATENT DOCUMENTS

| | | |
|---|---|---|
| DE | 3221994 | 12/1983 |
| FR | 916277 | 12/1946 |
| JP | 1980 5572683 | 5/1980 |

* cited by examiner

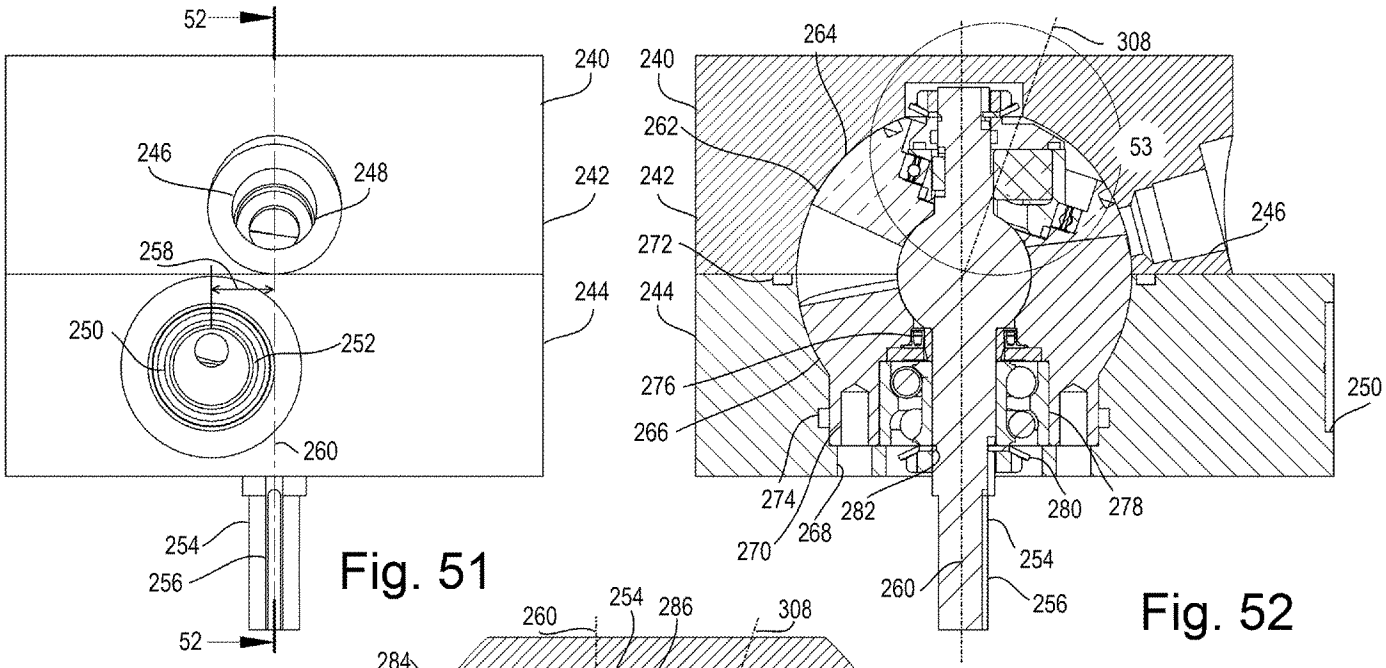
Fig. 51
Fig. 52
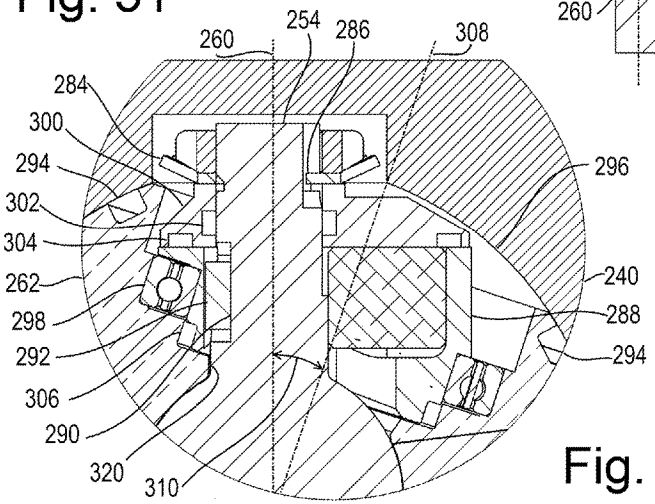
Fig. 53

DUAL AXIS ROTOR

BACKGROUND OF THE DISCLOSURE

Field of the Disclosure

This disclosure relates to the field of fluid transfer devices having a plurality of cooperating surfaces, one surface on a fixed stator and the other surface on a nutating rotor.

SUMMARY OF THE DISCLOSURE

Disclosed herein is a fluid flow apparatus comprising in one example: a housing having a frusta spherical inner surface; wherein the housing is fixed in space; a stator having a center axis, and a front face comprising lobes and valleys; the stator fixed to the housing; a rotor having an axis, and a frusta spherical radially outward surface; wherein the rotor nutates about the stator. In one example a static seal is provided between the frusta spherical outward surface of the stator and the inner frusta spherical surface of the housing. The apparatus may be arranged wherein the axis of the stator intersects the axis of the rotor; wherein the axis of the stator is offset from the axis of the rotor by an alpha ($\alpha$) angle. In one example, the rotor having a front face with lobes and valleys configured to interoperate with the lobes and valleys of the stator. In one example, the number of lobes on the rotor are equal to the number of lobes on the stator such that net rotation of the rotor relative to the stator is not permitted. In one example, the device is arranged wherein the lobes and valleys of the stator are substantially in fluid tight seal to the lobes and valleys of the rotor at least at two points during rotation/precession of the rotor.

One significant advantage of the lobe/valley face designs disclosed herein is the ability to produce a device wherein the surfaces of the pumping chambers are used to prohibit rotation of the rotor relative to the stator. Among others, U.S. Pat. No. 3,895,610 discloses a nutating apparatus wherein two segmental sections of a spherical body are rotated one relative to the other to compress a fluid. In this patent as with many of the prior art references known, gearing is required to provide the rotor with the necessary motion to follow the sinuous configuration of the stator. One significant advantage of the disclosed lobe/valley face designs disclosed herein is the ability to produce a device wherein the surfaces of the pumping chambers are utilized to prohibit rotation of the rotor relative to the stator. The working chamber remains at the same position relative to the stator while the chamber volume increases and decreases in a sinusoidal manner with every nutation cycle. In many examples this eliminates the need for timing gears in the apparatus. Prior art devices require the rotor to move in precession relative to the stator to manifest the volume change.

The fluid flow apparatus as disclosed herein may be arranged wherein the alpha ($\alpha$) angle is between three (3) and forty-five (45) degrees, or in a narrower range, between 25 and 35 degrees. In some applications, an alpha angle of thirty (30) degrees has been found beneficial.

The fluid flow apparatus as recited herein may be arranged wherein each of the stator and the rotor comprise an even number of lobes.

The fluid flow apparatus may be arranged wherein the lobes of each of the stator and second rotor comprise a leading surface comprising substantially a radial projection of a spherical involute. Alternatively, the lobes of each of the stator and second rotor comprise a leading (axial) surface comprising substantially a spiral spherical projection of a spherical involute.

The fluid flow apparatus may be arranged wherein the lobes of each of the first rotor and second rotor comprise a following (axial) surface comprising a radial projection of a teardrop curve.

The fluid flow apparatus as recited herein may be arranged wherein the second rotor is rotatably attached to a shaft passing through the housing and transferring rotational torque with the second rotor.

The fluid flow apparatus as recited herein may be arranged wherein the shaft passes through and rotates relative to the first rotor.

The fluid flow apparatus as disclosed herein may be arranged wherein the shaft comprises: a first portion adjacent to the first rotor and coaxial thereto; a second portion adjacent to the second rotor and coaxial thereto; and wherein the first portion forms an angle relative to the second portion equal to the alpha ($\alpha$) angle.

The fluid flow apparatus as recited above may further comprise: a main shaft passing through the housing and rotating relative thereto; a precession cam (eccentric rotor) fixed to the shaft so as to rotate there with; a precession shaft attached to the precession rotor so as to rotate about the main shaft at a precession angle thereto; wherein the precession shaft is attached to the second rotor coaxial with the axis of the second rotor; and wherein the precession shaft transfers rotational torque with the second rotor.

The fluid flow apparatus as recited herein may be arranged wherein the precession angle equals the alpha ($\alpha$) angle.

The fluid flow apparatus may be arranged wherein the precession cam and precession shaft are counterbalanced.

The fluid flow apparatus may further comprise an indexer such as those described in published and publicly available U.S. patent application Ser. No. 12/560,674 incorporated herein by reference for the technical features disclosed therein. In another example, the nutating rotor may be indexed using an epicyclic gear arrangement so as to maintain a predetermined gap or interference fit between said faces to provide sealing.

The fluid flow apparatus as recited herein may be arranged wherein the housing comprises: a first portion and a second portion fixedly attached to the first portion; wherein each of the first and the second portions each comprise an inner surface forming the frusta spherical inner surface of the housing; and wherein the first portion and second portion meet at the equator of the frusta spherical inner surface.

The fluid flow apparatus as recited herein may further comprise: surfaces defining inlet ports through the housing; surfaces defining outlet ports through the housing; wherein precession of the second rotor relative to the first rotors forms a region of maximum volume and a region of minimum volume between the first and second rotors; and wherein the inlet ports and outlet ports are in fluid communication with each of the valleys of the first and/or second rotor.

The fluid flow apparatus may be arranged wherein the inlet ports and outlet ports comprise check valves providing one-way flow of fluid though specific regions of the apparatus.

The fluid flow apparatus may be arranged wherein the inlet ports and/or outlet ports exit the housing substantially parallel to the shaft.

The fluid flow apparatus may be arranged wherein the inlet ports are angled to direct a fluid flow to non-contacting portions of the lobes and/or valleys to remove precipitating debris therefrom.

The fluid flow apparatus as disclosed herein may be arranged wherein the shaft comprises a surface defining a fluid conduit for passage of fluid for cooling and/or lubricant fluid to the second rotor. In one form, this is accomplished by a surface defining a longitudinal void through a substantial length of the shaft.

The fluid flow apparatus as recited herein may further comprise turbulence generating surfaces on non-inter contacting portions of the lobes of the first and/or second rotors.

The fluid flow apparatus may further comprise a rolling seal on the non-axial face of each lobe.

The fluid flow apparatus may further comprise a sliding seal on the axial faces of each lobe for self cleaning.

A nutating positive displacement device is disclosed herein, in one form comprising: a (stationary) stator and a (moving/nutating) rotor with equal number of mounds and valleys as the stator. In one form, the rotor follows a precessing motion with respect to the stator such that the central axis of the rotor is at a constant angle to the axis of the stator, and the rotor's axis rotates about the stator axis. The contoured seal faces of the mounds and valleys of the stator and rotor may be formed in such a way as to provide a predetermined gap or interference fit between said faces to provide sealing.

The device recited above may be arranged wherein the constant angle of precession (alpha ($\alpha$) angle) and smooth motion of the rotor are determined by a series of bearings, one or more bearings of which are mounted at an angle on a rotatable part, the rotatable part rotating about an axis that is parallel or collinear to the axis of the stator.

The device may be arranged wherein the stator and rotor are generally spherical in their radially outward extremities and housed or partially housed within an outer shroud assembly that has a spherically concave inner surface to engage the spherical outer surfaces of the stator and rotor with or without a predescribed gap between said surfaces. In one form the shroud member is stationary with respect to the stator and may provide a static seal between the shroud and stator.

The device may be arranged wherein the stator and rotor are generally spherical in extremities and housed or partially housed within an outer shroud assembly that has a spherically concave inner surface that is to engage the spherical outer surfaces of the stator and rotor with or without a predescribed gap between said surfaces, the shroud member being fixed with respect to the rotor and providing a static seal between the shroud and rotor component, and the shroud moves in a precessing motion along with the rotor.

The devices may be arranged wherein the mounds and valleys are comprised of a geometry such as that described in U.S. Pat. No. 6,634,873 incorporated herein by reference for the technical description therein, spherical involutes, or a combination thereof such that one side of a mound may be comprised of a curve disclosed in the '873 patent and the other side may comprise a spherical involute, and adjoining surfaces therebetween.

The device may be arranged wherein the spherical involutes provide a gap or interference fit for sealing.

The device may be arranged wherein the spherical involutes also provide seal surfaces to transfer force from the rotor to the stator.

The device may be arranged wherein the lobes of the stator and rotor are designed as balanced (by the methods described in U.S. Pat. No. 6,497,564 incorporated herein by reference) wherein undercuts are created so that the net torque due to fluid pressure around all of the lobes of the rotor is balanced, or rather, the net torque is made effectively equal to zero by carefully designed cuts in the mounds and valleys.

The device may be arranged wherein the mounds of the lobes have apexes that are long and relatively thin and may become positively activated by pressure and deflect due to pressure causing the apexes to touch-down on the opposing mound or valley forming a contacting seal.

The device may further comprise movable apex seals that are either spring loaded or pressure activated and positioned at the apex or near the apexes of the rotor and/or stator lobes.

The devices above may be arranged where the apexes of the mounds are:

- constant radius along their length and form a portion of a cylinder or
- conical or
- portion of the apexes are flat or nearly flat such that when a rotor lobe apex is at its maximum distance away from the stator during a precession, the flat sides of the lobes of the rotor and stator form a gap seal such that an escaping fluid would need to traverse a relatively long gap length in order to leak thus forming something much like a labyrinth seal at this position, or
- mound apexes that incorporate a cross sectional shape similar to that shown in U.S. Pat. No. 7,837,451 B2 FIG. 9, the edge meant to reduce leakage by a labyrinth effect and may be incorporated on either rounded apexes or flat apexes of mounds.

The device disclosed above may be arranged wherein the rotor and stator mounds and valleys are formed of the same surface shapes. These shapes may be circumferentially symmetric.

The devices above may be arranged wherein the rotor has mounds of a different (circumferential) width than the mounds of the stator.

The devices disclosed above may be arranged wherein the mounds and valleys are produced as illustrated in U.S. patent application Ser. No. 12/560,674. The apparatus disclosed in FIG. 12 of that disclosure may be exemplary for this application, whereby the apexes extend sideways. Alternatively, the mound/valley shapes shown in U.S. Pat. No. 6,923,055 (incorporated herein by reference for the technical support it provides) FIGS. 6A/6C item "D", and FIG. 9 item 50, are termed a "rabbit ear" design. This particular teardrop lobe shape is created by a process wherein, this rabbit ear (or "cutter") is a cone or cylinder or oval (or other shape) that is aligned tangent to the teardrop shape of the lobe such that it appears to extend like ears on a rabbit (where the axial direction corresponds to the up/down direction of a rabbit standing up with his ears up). In U.S. patent application Ser. No. 12/560,674, FIG. 12 the cutters are attached no longer on teardrop base curves but instead are attached to ovals, and the result is that the tangent of the oval is 90 degrees rotated from the tangent of a teardrop base curve. The result is the cutters are attached "sideways"—the rotor tips cantilever sideways if the rotor is viewed end-on. Alternatively, rotors and stators with the mound and valley shapes disclosed in U.S. Pat. No. 3,101,700 may be utilized.

Devices described above may incorporate, for example, indexers illustrated in U.S. patent application Ser. No. 12/560,674 such as the rollers within oval tracks, ball bearings in oval tracks, lenticular gears, other forms of constant velocity fixed angle joint, or an indexer such as the Spherical Involute Gear Coupling (U.S. patent application Ser. No. 13/467,628 filed May 9, 2012) or other timing gear system such as bevel gears, spiral bevel gears, Zerol bevel gears, such that the stator and rotor are prevented from contacting each other by means of this indexing or timing device, timing device to impart a constraint such that the axial rotational motion of the rotor with respect to the stator is negligible and to remove backlash if required.

The devices disclosed above may be arranged with movable sealing members either pressure activated and/or spring loaded or pressure balanced, that are positioned so as to seal between the inside spherical surface of the shroud and the outside spherical surface of the rotor or stator.

The devices above may be arranged whereby the rotor is pressure balanced on the reverse side so as to balance against the fluid pressure within the mounds and valleys of the device.

The devices disclosed above may be arranged where vibration due to the nutation motion is dynamically or statically balanced by means of adding or removing counterweights, or the addition of one or more additional rotors that are positioned along the same main drive shaft strategically to reduce or eliminate such imbalance.

The devices disclosed above may be arranged, whereby the shroud (housing) is fixedly attached to the stator, and the shroud is of a short enough length such that the valleys of the rotor are exposed at the maximum volume position so as to act as an intake port, and subsequently discharge porting may occur by porting through the central ball/rotating shaft such that the discharge porting is arranged such that as the rotor nutates at the maximum volume position the discharge porting is closed but at the minimum volume positions the discharge porting is open to the discharge header (through the shaft). The apparatus may alternatively be arranged where the intake is through the shaft and discharge is out the edge of the shroud. In yet another iteration, intake or discharge porting can be done through the back face of the stator with a series of check valves to prevent backflow.

The shroud (housing) can be arranged such that it fully encloses both rotors. In such an application, it may be desired that the shroud has an opening or openings in the vicinity "above" the fixed rotor sawtooth lobe tip or tips respectively; this port(s) can serve as an intake for a compressor, or as a discharge for a expander.

The shaft ball may be ported for fluid to pass in combination with a sawtooth lobe rotor, where the port will communicate high pressure gas between the rotors and a high pressure fluid (such as compressed gas) reservoir that is communicated through the axis of the shaft, where the rotation of the shaft with respect to the fixed rotor allows the port to be sealed off as a sawtooth rotor lobe blocks the port. Alternatively, the rotor and or stator may utilize dual teardrop shaped lobes (more rectangular shaped lobes).

The apparatus may include a shaft produced of a bent shaft manufacture method. Such a method increased accuracy of manufacture by having tilted rotor positioned by a 5 axis machining operation, all in one fixture, drilling a hole and having a tight fit to extension shaft to tilted rotor.

Also disclosed is an improvement of adding features like on lobe tips of screw compressors. In one example this improvement comprises a very thin and very small embossed protruding lip that extends from lobe tips and from exterior lobe spherical surfaces, such that the protruding material can quickly wear-in, much like an abradable material but made of the same or similar material as the lobes themselves, the feature could be machined on or inserted into the lobes.

In one example, the stator rotor is manifolded at an inner ball location and ported there past. In this example, the shroud may be attached to the stator. An upper nutating rotor may be utilized, wherein the shroud is a sealed chamber, wherein the nutation area may then be flooded with inlet fluid, the bent through shaft has "seal blocks" carved into the ball, and the inlet and discharge porting on bent shaft go in opposite directions. Referring to FIGS. 61 to 71, a "bent shaft" nutating device with a set of 6 lobe rotors is shown. The lobes of this example are formed from spherical involutes on the outer edges of one rotor that roll on the spherical involute surfaces of the opposite rotor. The rolling contact is therefore localized to the outer edge and most of the involute surface on one rotor is offset from the surface of the opposing stator to minimize the rolling contact surface area and minimize grinding effect if there is debris in the working fluid. This offset also minimizes cavitation created by a large rolling contact surface lifting off from another quickly. The rotor tips of the rotor in FIG. 63 are cut in such a way as to create "balanced rotors" such as those disclosed in U.S. Pat. No. 6,497,564. The outer housing has an inlet 360 at the top, and in one application the working fluid fills the entire upper chamber 362 above the rotor 406. The fluid passes through ports 416 in the top of the rotor 406 into a toroidal groove that lies centered on the upper rotor axis between the upper rotor and the central ported ball. The central ported ball 418 in this example has a groove 426 functioning as an inlet groove where fluid enters the rotor lobe chambers. When fluid is discharged, the fluid exits a groove 438 which is 180 degrees opposite groove 426. Grooves 426 and 438 are on opposite sides of an imaginary plane formed by two axes, the rotor axis and the stator axis. The spherical surface of the inner ball 418 may include a seal or a sealing gap with respect to the inner spherical sockets of the upper and lower rotors. As the rotor 406 nutates, fluid enters cutaway portion 426, and with nutation is then discharged out cutaway portion 438 downwards out past the bottom surface 444, into a toroidal groove 428 in the stator below the ball. This toroidal groove 428 in one example has one or more discharge ports 430 connected to it through the housing.

In one example, the housing portions are arranged differently from those disclosed herein. It is also conceived to produce the housing in fewer (or more) components, or as a unitary (monolith) structure.

In one example, the device functions as a centrifugal nutating or combination of centrifugal and nutating pump.

It may be beneficial to provide the apparatus with a two lobe or even number of lobe involute sawtooth with even number of check valves, the even number resulting in reduced pulsation.

In one example as shown in FIGS. 8-50, the apparatus is provided with a large angle, full dome housing where the upper rotor and its bearing are contained completely within the upper half dome of the housing. This full dome housing allows for a very large tilt angle of the bent shaft arrangement and therefore a higher volumetric capacity.

BRIEF DESCRIPTION OF THE DRAWINGS

FIG. 51 is a side view of one example of the disclosed apparatus including a housing and shaft.

FIG. 52 is a cutaway view taken along line 52-52 of FIG. 51.

FIG. 53 is an enlarged view of area 53 of FIG. 52.

DESCRIPTION OF THE PREFERRED EMBODIMENTS

Figure 2:
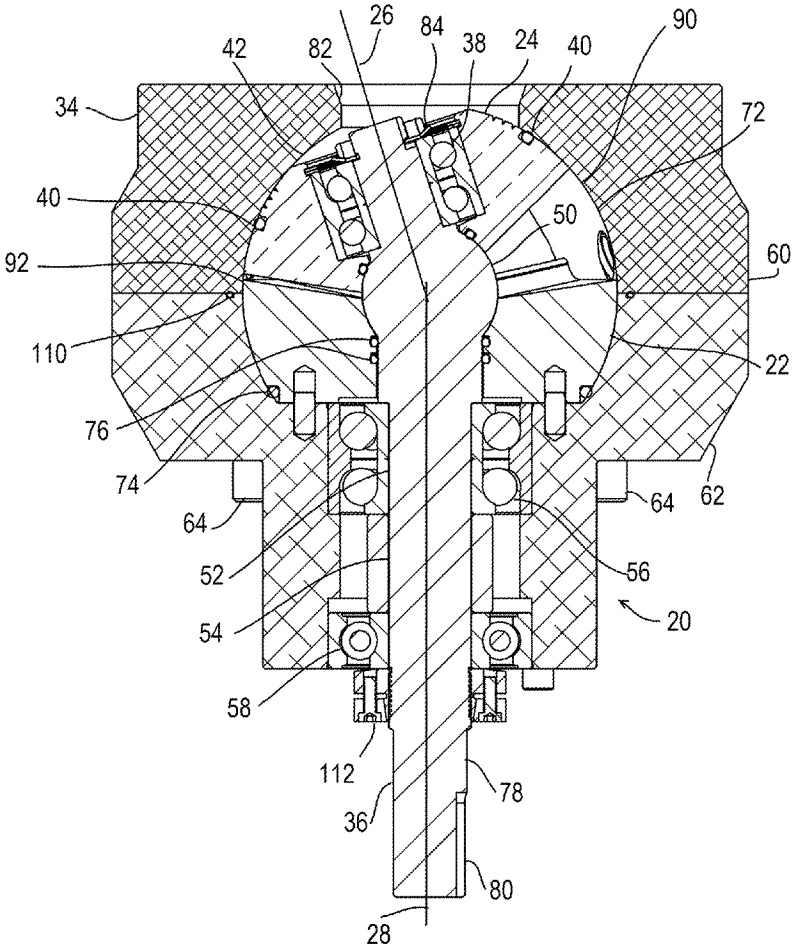
FIG. 2 is a cutaway view taken along line 2-2 of FIG. 1.

This disclosure concerns an advanced nutating positive displacement device having a high power to mass ratio and low production cost. This device in one example forms an exemplary pump as will be discussed in detail.

In the case of pumps, there are many general types of pump design known, such as positive displacement, centrifugal and impeller. Pumps of the positive displacement type are typically reciprocating or rotary.

The examples disclosed herein are of the rotary positive displacement type, but in a class by themselves. The devices are formed by a nutating rotor having a face comprising lobes and valleys, and a fixed stator also having a face with lobes and valleys. The face of the rotor opposes and cooperates with the face of the stator. The opposing faces define chambers that change volume with rotation of the rotor.

An engine of this type defines a new class of engines, and includes a minimum number of moving parts, namely as few as two in total.

In one aspect of the invention, a pump includes a nutating rotor and a cooperating stator, both within the same housing. The housing has an interior cavity in one example having a frusta-spherical inner facing surface adjacent the radially outer surface of the rotor. In one example, the rotor is mounted on a shaft that passes through the center of the cavity, the axis of the rotor and the line normal to the face of the stator being at an angle to each other, with the center of the rotor being at the center of the cavity. The rotor and stator interlock with each other at the opposing faces (lobes and valleys) to define chambers. Lobes defined by a contact face on one side of the vane and a side face on the other circumferential side of the lobe longitudinally protrude from the rotors. In one example, each contact face of the rotor is defined by the rotation of a conical section of material at the tip of a cooperating lobe on the stator, so that there is constant linear contact between opposing lobes on the rotor and stator as the rotor nutates about the face of the stator. One example of such lobe and valley construction is shown in U.S. Pat. No. 5,755,196, and another example is disclosed in U.S. Pat. No. 6,705,161. The side faces in one example are substantially concave and extend from an inner end of one contact face to the outer end of an adjacent contact face, equivalent to the tip of a lobe. The side faces and contact faces define walls of chambers that change volume as the rotor nutates. Ports for intake and exhaust in one example are generally configured to the position of the chambers relative to the stator.

To enhance performance, turbulence generating surfaces may be provided on non-inter contacting portions of the lobes of the first and/or second rotors.

These and other aspects of the disclosed apparatus and method for manufacture and use of the apparatus will be described in more detail in what follows and claimed in the claims appearing at the end of this patent document.

Disclosed herein are several examples of rotary positive displacement devices based upon a nutating or precession motion. Such motion in prior art applications is commonly based on swashplate mechanisms that drive a series of linkages and pistons. Several examples of rotors are disclosed herein, including examples which cooperate with fixed stators. Spherical trochoid shaped rotor and stator shapes are disclosed, that in some examples exhibit an additional rotational advancing precessional motion (rotational walking motion) due to an N, N+1 number of rotor lobes in comparison to the stator. Several novel examples are disclosed herein, such as the example of a nutating rotor assembly 20 shown in FIGS. 1-6 which utilizes a stator 22 fixed to a housing 34 and a precessing rotor 24 to create a nutating motion. Unlike N+1 trochoidal devices disclosed in other applications, the example rotor 24 does not substantially rotate in relation to the stator 22. The rotor's central axis 26 position rotates with respect to the stator axis 28, creating a precessing motion of the rotor in relation to the stator. The shape of the extremities of the stator 22 and rotor 24 are generally spherical and the stator 22 and rotor 24 may have an equal number of mounds 30 and valleys 32 (FIG. 6). These mounds 30 and valleys 32 in one form are shaped in such a way as to form continuous or semi-continuous contacting or gap seals through the entire rotation of the device.

The term "nutation" (from Latin: nūtāre, to nod) is a rocking, swaying, or nodding motion in the axis of rotation of a largely axially symmetric object, such as a gyroscope, planet, or bullet in flight, or as an intended behavior of a mechanism. A pure nutation is a movement of a rotational axis such that the first Euler angle (precession) is constant. In spacecraft dynamics, precession is sometimes referred to as nutation.

The term fluid used herein to denote a substance, as a liquid or gas, that is capable of flowing and that changes its shape at a steady rate when acted upon by a force tending to change its shape.

The nutating rotor assembly shown in several examples (such as the nutating rotor assembly 20 shown in FIGS. 1-6) differs from known prior art in several ways. Rather than both cooperating faces spinning on a fixed shaft or shafts, the shaft 36 rotates, resulting in nutating motion of a rotor while an opposing stator 22 is fixed to a housing 34. In one example, the rotor 24 is moved in a nutating manner by an offset (upper portion 88) of the shaft 36 and the rotor thus nutates in relation to the stator 22 at an alpha ($\alpha$) angle to the shaft 36. In those prior art examples utilizing a "shroud" about the rotors, the "shroud" is now the housing 34, or part of the housing 34. One such apparatus is shown in published and publicly available U.S. patent application Ser. No. 13/162,436, which is incorporated herein by reference for the technical features it discloses. Returning to the example of FIG. 1, such a nutating rotor assembly 20 results in fewer parts, reduced size and reduced weight over many prior art examples for apparatus with equivalent fluid flow (volume) characteristics. As the housing 34 of this example is stationary, flanges and/or threaded connections (ports 36) may be provided on the housing 34 rather than through the rotors as was often previously required. In the examples disclosed herein, the relative rotational velocities and relative surface velocities of the rotor 24 relative to the housing 34 are generally slower than in prior applications of rotor-rotor fluid transfer devices. Such slower relative rotational velocities/surface velocities improve the assembly's use of more readily available fluid seals than previously possible. In testing it has been found that there is often an imbalance associated with nutation that must be counterbalanced, for example by using self-adjusting dynamic balancing weights.

Several benefits of prior through-shaft designs may still be accomplished when such through-shaft designs are combined with the nutating rotor concepts and examples disclosed herein. Such benefits include transmission of tension force through the shaft. In several of the examples shown herein, such as the nutating rotor assembly 20, the shaft 36 can be a bent shape and no longer needs to be straight. Utilizing such a bent shaft allows for utilization of smaller bearing 38 and seal 40 arrangements on the back end 42 of the nutating rotor 24. Therefore the bearings 38 and seals 40 may be cheaper and more reliable than those required in prior applications. There may also be provided more space on the back end 42 of the nutating rotor 24 to provide for pressure balancing to reduce loads, or more ability for using other forms of bearings such as tilt pad bearings or hydrostatic bearings, using larger available surface area that is not available with prior rotor-rotor designs.

With the more compact back end 42 of the nutating rotor 24, it is conceived to more effectively pressure balance the rotors 24. Looking to FIG. 5, by reducing the diameter of seal 40 such that it were to sit very close to bearing 38, high pressure seepage is permitted on surface 24. This pressure area 24 would oppose pressure on surface 94 for example, reducing the overall thrust load.

A nutating flow through pump utilizing a "booster pump" 44 as shown in the nutating rotor assembly 46 shown in FIGS. 84-89 may be integrated by mounting fan-like blades 48 to the fastener or shaft 374 which retains the collar or shaft 400 in position relative to the lower shaft 370. The blades rotate about the axis of the shaft 370, and in this example do not nutate with the rotor 406. The motion experienced is similar to a lasso, where the blades are attached well offset from the center of rotation.

Figure 91:
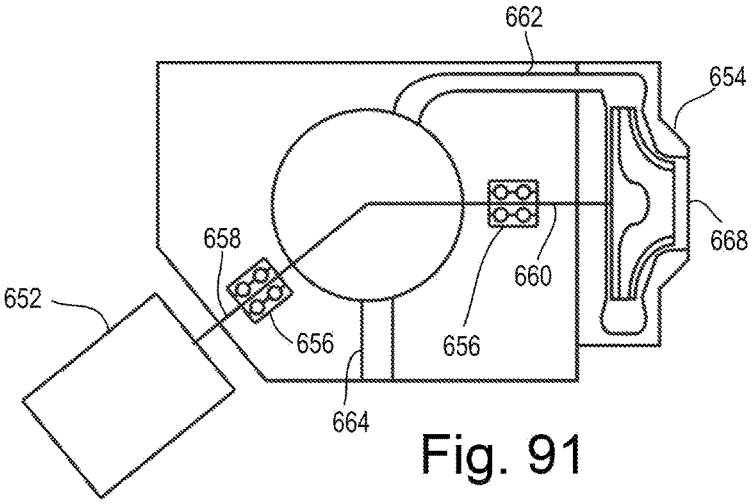
FIG. 91 is a highly schematic view of a booster pump arrangement.
Figure 92:
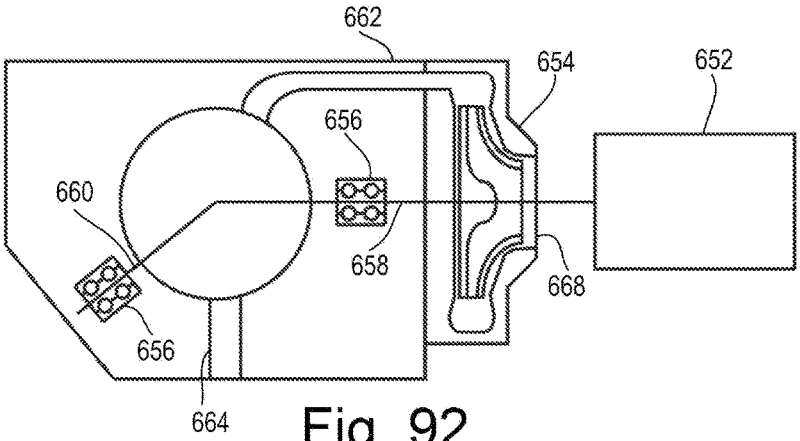
FIG. 92 is a highly schematic view of another booster pump arrangement.
Figure 93:
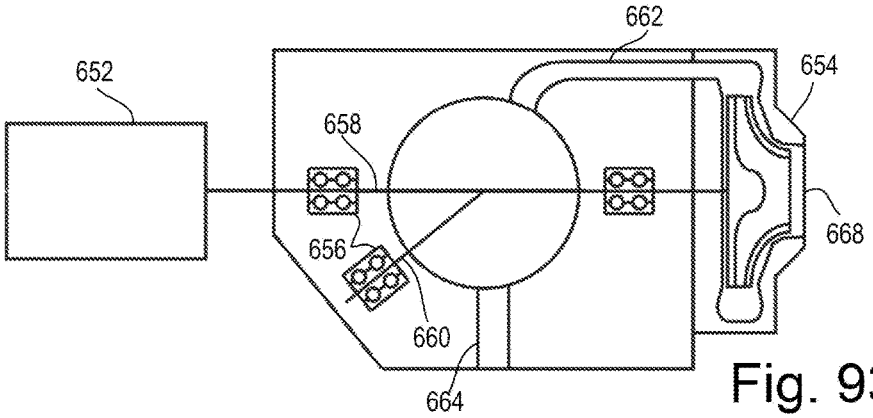
FIG. 93 is a highly schematic view of yet another booster pump arrangement.

Other arrangements of the booster pump are shown highly schematically in FIGS. 91-93 in their relation to a motor 652, shaft bearings and seals 656, main (driving) shaft 658, offset shaft 660, fluid conduit 662 and fluid outlet 664. This highly schematic view of a booster pump 654 shows an inlet 668 fluidly upstream of the booster pump 654. These arrangements may be utilized with a nutating arrangement, or in a pump utilizing a cooperating pair of rotors. In one example, a non-positive displacement pump is provided on the same shaft and/or in the same housing as a positive displacement pump which may be a nutating or spinning architecture. In another example, a first positive displacement pump is provided on the same shaft and/or in the same housing as a second positive displacement pump which may be of nutating or spinning architecture.

In other examples, the booster pump may be a centrifugal booster/charge pump mounted on the same shaft as the rotor of the main (post booster) pump.

In one example, the main pump operates with a nutating rotor, in other examples the booster pump may be applied to non-nutating main pumps, such as those disclosed in applicants prior patent applications.

In one example, the booster pump is mounted on the same shaft as the main pump and shares the same housing. This example significantly reduces space and sealing requirements.

Returning to the example shown in FIGS. 1-6, previous difficulties encountered in producing rotor-rotor assemblies, housing and other components concentric to the center of a sphere, have been made less of a concern as the central bent shaft 36 with a center ball 50 can be machined very accurately. This machining advantage is also seen in respect to the bearing supports 52/54. In one example, the bent shaft 36 has an upper bearing shaft location on the outer surface of upper shaft portion 88 (FIG. 5) which engages bearing 38. The shaft 36 in one example also has a lower bearing location adjacent to and in contact with a surface of bearings 52 and 58. This design provides for enhanced ease and accuracy in production in that the upper bearing location, the ball, and the lower bearing locations may be one unitary part. This design reduces machining operations, eliminates much of the tolerance stack-up difficulties of prior rotating machinery designs and split shaft designs where the alignment often depended on a split housing with much more potential for tolerance stack-up issues. To this same shaft 36, one or two machining fixtures may govern both the angle of the shaft 36, and bearing 56/58 positions. Tolerance stack up (accumulation) may also be reduced as a result of these designs.

Figure 1:
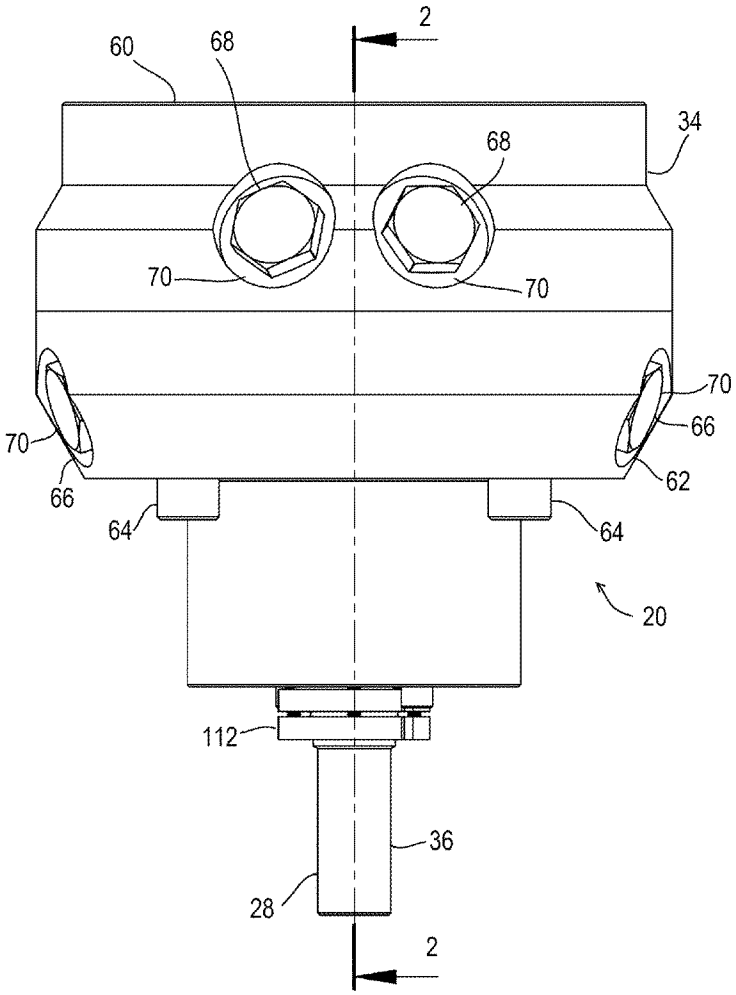
FIG. 1 is a side view of one example of the disclosed apparatus including a housing and shaft.

Looking to FIG. 1 is shown one example of a housing 34 which in this example is comprised of an upper housing component 60 and a lower housing component 62. These sub-components may be fastened together by way of bolts 64 or other fasteners or fastening methods. FIG. 1 also shows a plurality of upper and lower ports 66/68 through the housing 34 which may comprise check valves 70. In one example the inlet ports are angled to direct a fluid flow to non-contacting portions of the lobes and/or valleys to remove precipitating debris therefrom. Looking to FIG. 6 it can be seen how with the housing 34 removed the check valves 70 are positioned adjacent an open region between the stator 22 and rotor 24. As the rotor 24 nutates about the stator 22, this open region between a valley 32 and opposing mound 30 will tend to increase and decrease in volume. Therefore, unlike prior designs which ported through the rotors, in this example using through-housing ports, check valves may be very beneficial to allow for one-way flow through each of the ports 66/68. Also shown in FIG. 1 is a shaft bearing holder assembly 112. In one example, the bearing holder assembly 112 generally holds the bearing assembly 58 in place during operation.

Moving to the example of FIG. 2, the internal components previously discussed are clearly shown. In addition to the dynamic seal 40 interposed between the rotor 24 and the inner spherical surface 72 of the housing 34 is a static seal 74 which cooperates with rotary seals 76 to prohibit or at least reduce fluid flow past the stator 22 toward the lower bearings 56/58.

Figure 3:
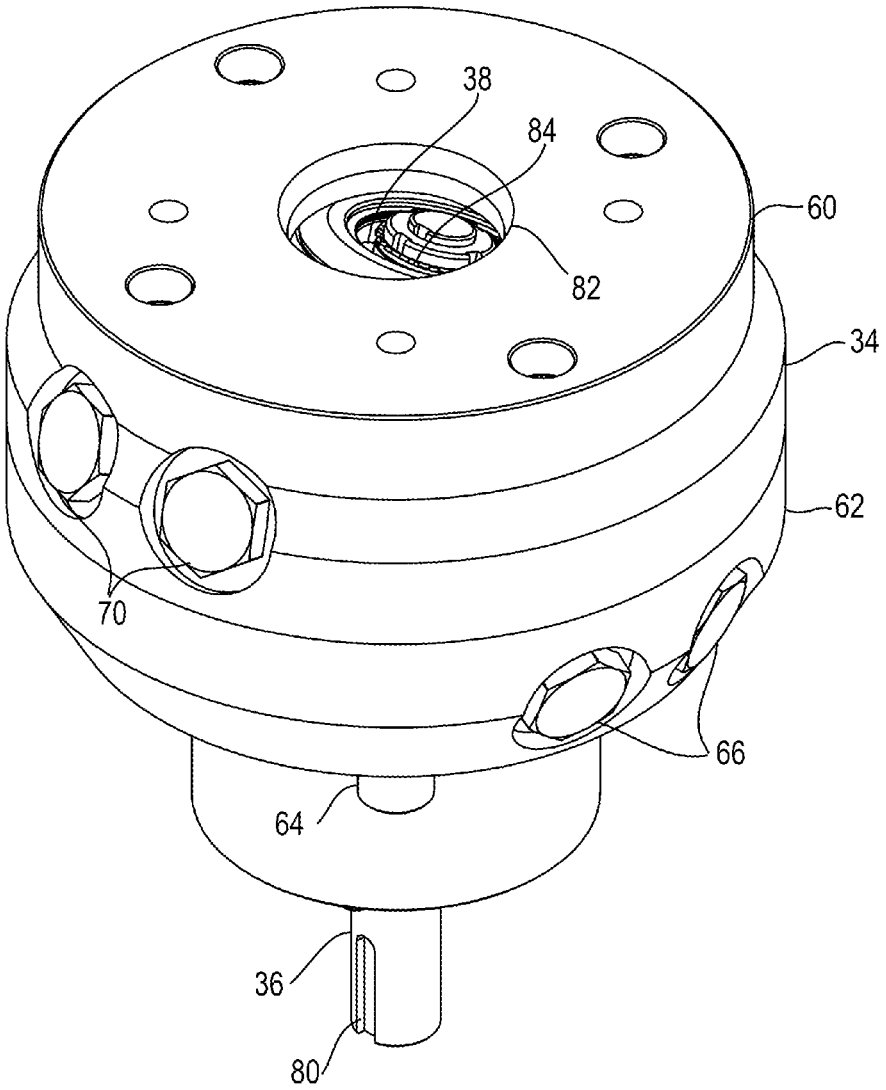
FIG. 3 is a top isometric view of the example shown in FIG. 1.

Looking onto FIG. 3, the housing 34 can be seen including the upper housing component 60 and lower housing component 62. The check valves 66/70 can also be seen as well a portion of the fasteners 64. The shaft 36 is seen as well as a keyway 80 which can be utilized for attachment of the shaft 36 to a motor, engine, or similar device for rotation of the shaft 36. In addition, a surface defining an upper opening 82 is shown which allows access to the bearings 38 as well is a bearing retainer or keeper 84. Other uses for the opening 82 include providing a conduit for lubrication of the upper bearings, or application of a hydrostatic oil pressure to reduce the axial load on the upper bearing 38.

Figure 4:
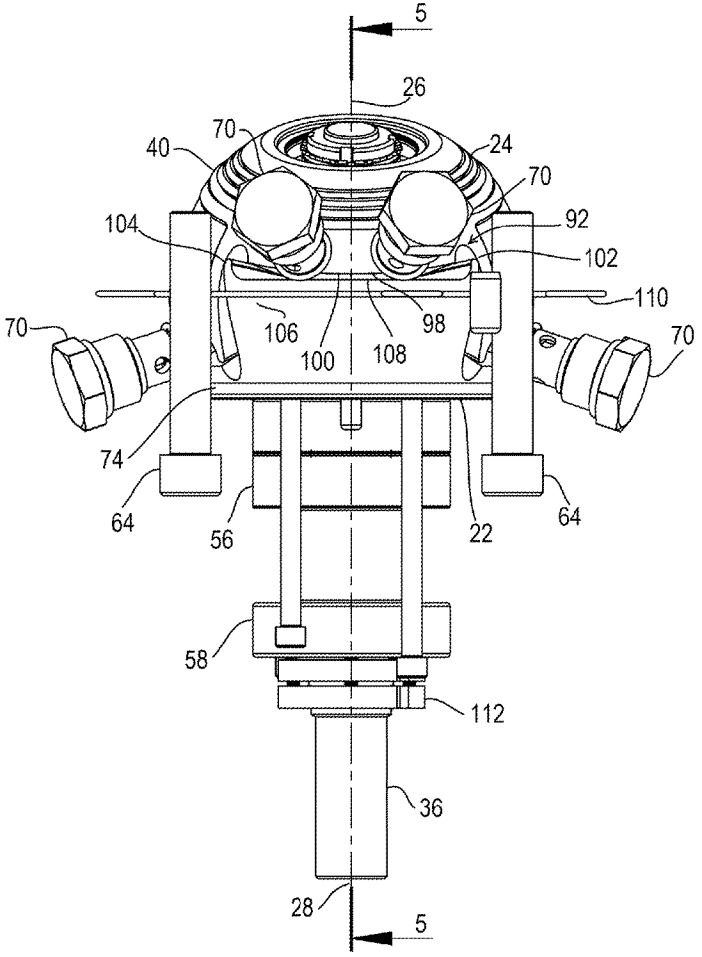
FIG. 4 is a side view of the example of FIG. 1 with the housing removed to show the internal components.

Looking to FIG. 4, the internal components such as the rotor 24 and stator 22 can be more easily seen.

Figure 5:
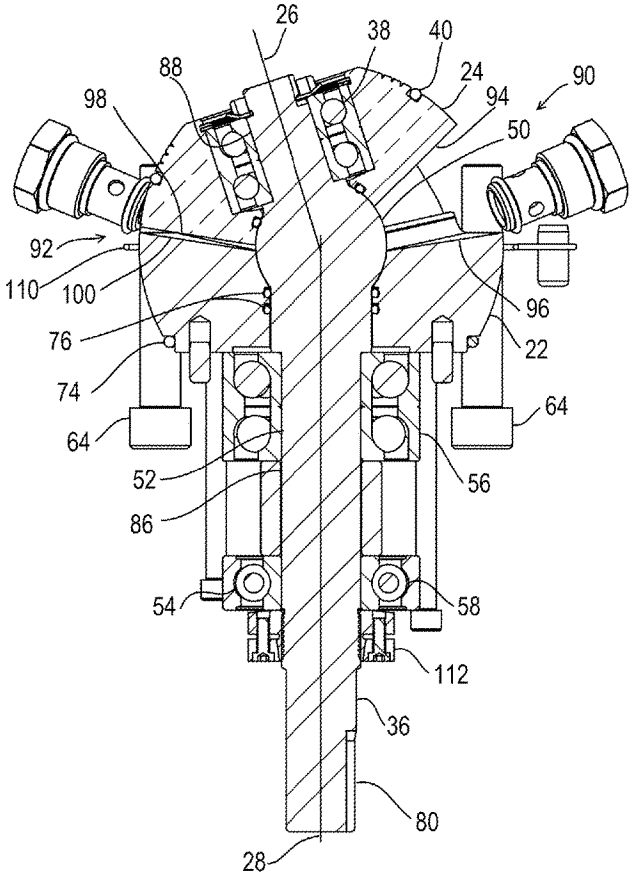
FIG. 5 is a cutaway view taken along like 5-5 of FIG. 4.
Figure 6:
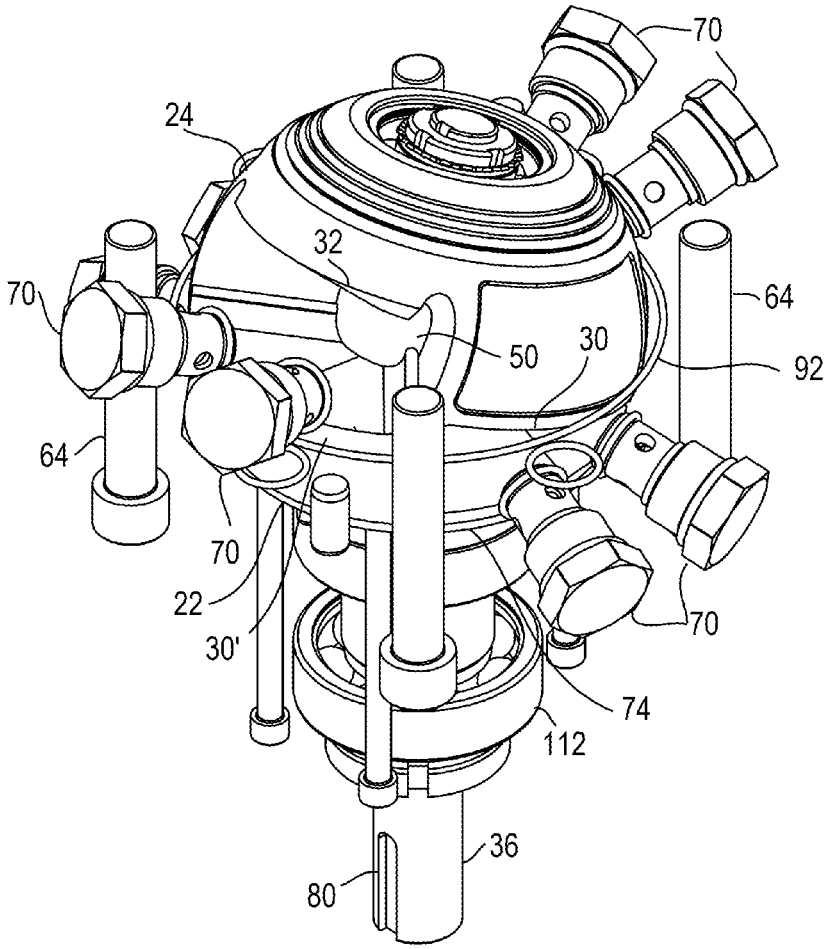
FIG. 6 is a top isometric view of the example shown in FIG. 4.

Looking to FIG. 5, as can be appreciated that in this example, the shaft 36 comprises a lower portion 86 generally aligned with the stator axis 28 and an upper portion 88 generally aligned with the rotor axis 26. The spherical surface (ball) 50 of the shaft is positioned there between. This arrangement is generally termed herein as a "bent shaft" as can be understood by looking to FIG. 5 where the angle between the upper portion 88 and lower portion 86 appears to be a bend in the shaft 36.

As can be appreciated by looking to FIG. 1 through FIG. 5, the rotor position of FIG. 5 shows maximum displacement 90 in the right portion between the surface 94 of the rotor 24 and the surface 96 of the stator 22. Likewise, on the opposing circumferential side of the apparatus, a point of minimum displacement 92 is shown between the surface 98 of the rotor 24 and the surface 100 of the stator 22. As the shaft 36 rotates relative to the housing 34, and as the stator 22 is fixed to the housing 34, it can be appreciated that in this cutaway view there will be a slight rotation of the rotor 24 relative to the stator 22 however, most of the apparent motion in this cutaway view will be a pivoting motion about the ball surface 50. This will result in the volume between the surfaces 94/96 reducing as the volume between the surfaces 98/100 increases and vice versa. As the shaft 36 passes a position 180° rotationally opposed to the review of FIG. 5, the volume between the surfaces 94 and 96 will approach a minimum volume, and the volume between the surfaces 98 and 100 will approach a maximum volume.

As the shaft 36 continues to rotate relative to the stator 22, this process will reverse until the position shown in FIG. 5 is again achieved. Thus, in a two-lobe, two-valley rotor device, an oscillating volume chamber is created on either side of the apparatus. Looking to FIG. 4, seal points 102 and 104 can be seen on both sides of the lobe 106. In this position the surface 100 of the lobe 106 is adjacent the surface 98 of the valley 108. These lobes, valleys and the relative positions there between as well as the seal points will be discussed in more detail. In one form, the lobes 106 and valleys 108 of the stator 22 and rotor 24 are very similar to the apparatus shown in FIGS. 74-77 which will be described in more detail.

Figure 7:
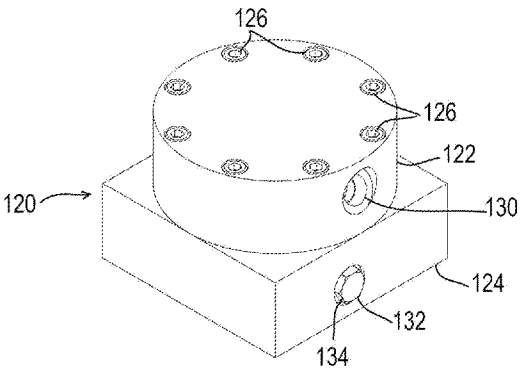
FIG. 7 is a top isometric view of another example of the disclosed apparatus, including a housing.
Figure 9:
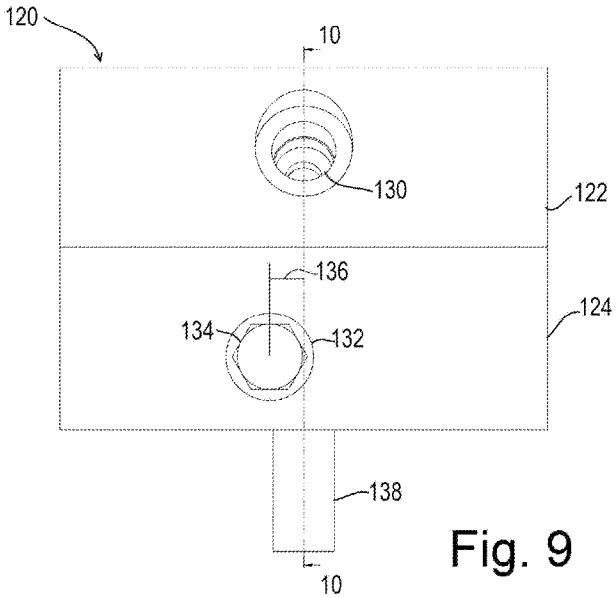
FIG. 9 is a side view of the example shown in FIG. 7.
Figure 10:
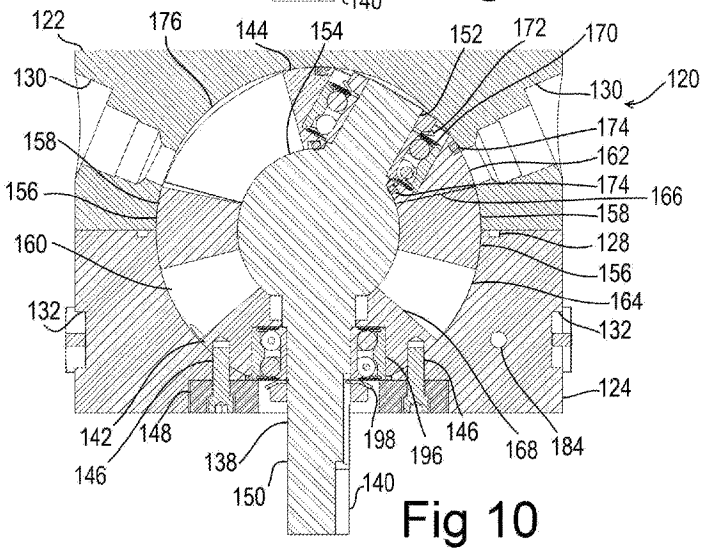
FIG. 10 is a cutaway view taken along line 10-10 of FIG. 9.

Looking to a variant of the previous example as shown in FIGS. 7-50, several similar components with similar functions are disclosed, as well as novel components, arrangements, functions, and designs. FIG. 7 clearly shows a housing 120 comprising an upper housing component 122 attached to a lower housing component 124 by way of a plurality of fasteners 126. As can be seen in FIG. 10, a static seal 128 similar to seal 110 of the previous example may be provided between the upper housing component 122 and the lower housing component 124 to eliminate any fluid flow there between. Although the upper housing component 122 is shown as a cylinder, and the lower housing component 124 is shown rectilinear, other shapes could be equally as effective in function.

Figure 8:
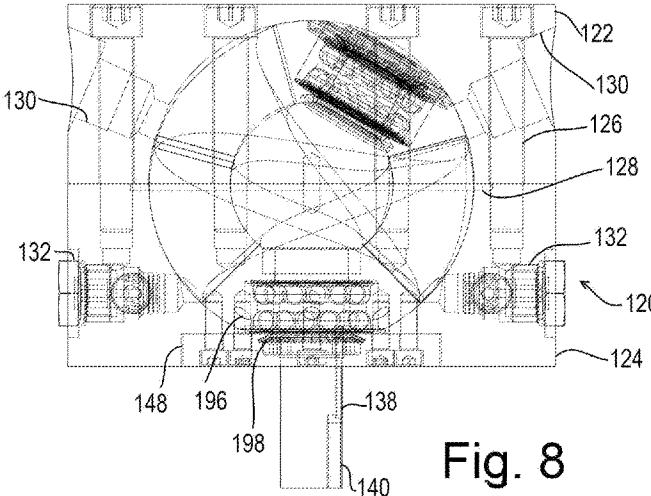
FIG. 8 is a hidden line side view of the example shown in FIG. 7.

Returning to the example of FIG. 7, an upper port 130 and a lower port 132 are utilized as can be more easily understood by looking to FIG. 10 or the hidden line view of FIG. 8. A check valve 134 may be provided in the lower port 132 to allow fluid flow in only one direction and to provide a cracking pressure which may be beneficial to operation. In some applications a check valve 134 may also be incorporated into the upper port 130. As can be understood looking to the front view of FIG. 9, the lower port 132 may be offset 136 from a centerline 10-10 as will be understood upon forthcoming disclosure of the interworking components. As with the previous example, a shaft 138 may be provided and the shaft 138 may include a keyway 140 as discussed in the first example.

Looking to the example shown in FIG. 10, it can be seen how the stator 142 may be fixedly attached to the lower housing 124 by way of a plurality of fasteners 146. The rotor 144 is generally allowed to move in a nutating motion about the lower portion of the shaft 138 as will be discussed in detail. A stability ring 148 may be utilized to provide a better connection between the housing 120 and the stator 142; and to retain lower bearing 196.

Continuing with a review of the components shown in FIG. 10, it can be seen that the shaft 138 comprises a lower portion 150 and an upper portion 152 in this example, with a bend therebetween generally centered upon a spherical surface 154. Again, this example shows a bent shaft variation similar to that shown in reference to FIGS. 1-6.

Figure 16:
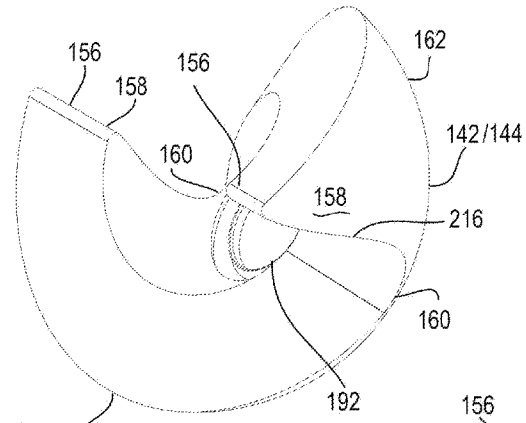
FIGS. 16-20 show a rotor component shown in FIG. 13. It is to be appreciated that the stator in one example will have lobes and valleys forming substantially an identical surface (face) as the rotor depicted here.
Figure 17:
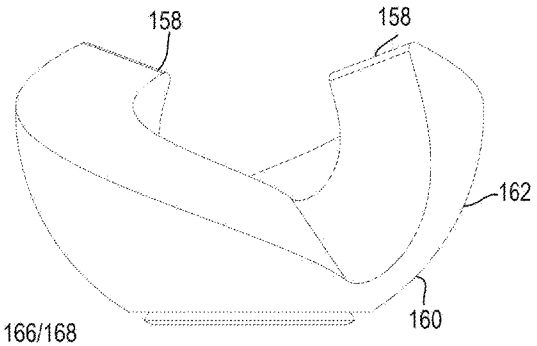
Figure 19:
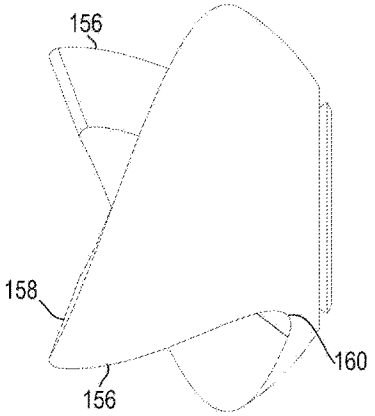
Figure 20:
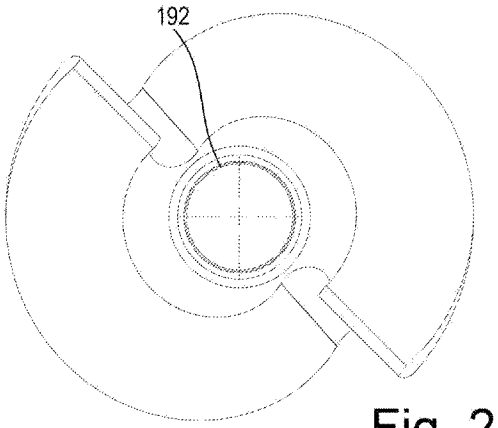
Figure 18:
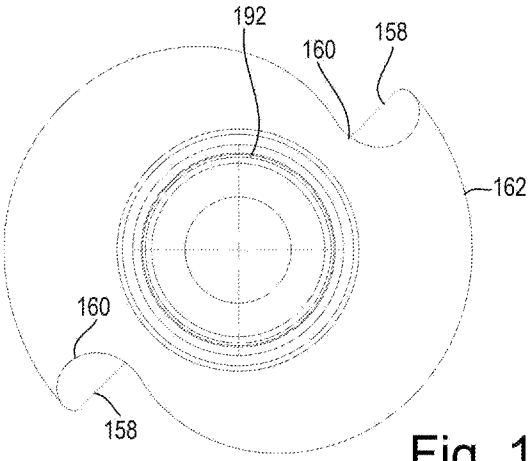
Figure 25:
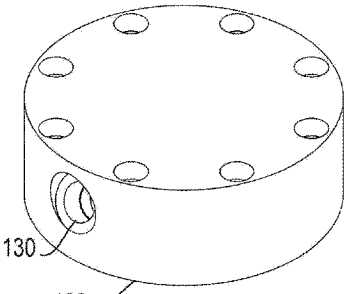
FIG. 25 shows a top isometric view of the upper housing component of FIG. 24.

As can be further seen in FIG. 10, in the rotational position shown, the stator 142 comprises an overhang portion 156 which can more easily be understood by looking to FIG. 16 or 19 were a distal end of the lobe 158 sits circumferentially offset from the associated valley 160. This overhang arrangement is pointed out as it may create some confusion in the cutaway view of FIG. 10. In addition, it can be seen how a radially outward spherical surface 162 of the rotor 144 blocks and seals the port 130 at least at one point in nutation. In this configuration, when used as a fluid pump or compressor, the port 130 may be utilized as an inlet port and as the rotor 144 nutates to a position wherein the port 130 is blocked, continued nutation will reduce the capacity of the associated displacement chamber 164 between a lower surface 166 of the rotor 144 and an upper surface 168 of the stator 142. As the capacity of the associated displacement chamber 164 continues to reduce, fluid within the displacement chamber 164 will be forced through the check valve 134 through the port 132. Further discussion of the relative motion of the stator 142 in regards to the rotor 144 will follow, and the effects of the nutating rotor in combination with the stator and housing on fluid displacement will be better understood.

As with the previous example, the example shown in FIG. 10 utilizes an upper bearing 170 which is held in place partially by way of a bearing keeper 172. Fluid seals 174 may be provided between the rotor 144 and the shaft 138 as well as between the rotor 144 and a spherical surface 176 of the housing 120 to reduce fluid flow past the bearing 170.

Figure 12:
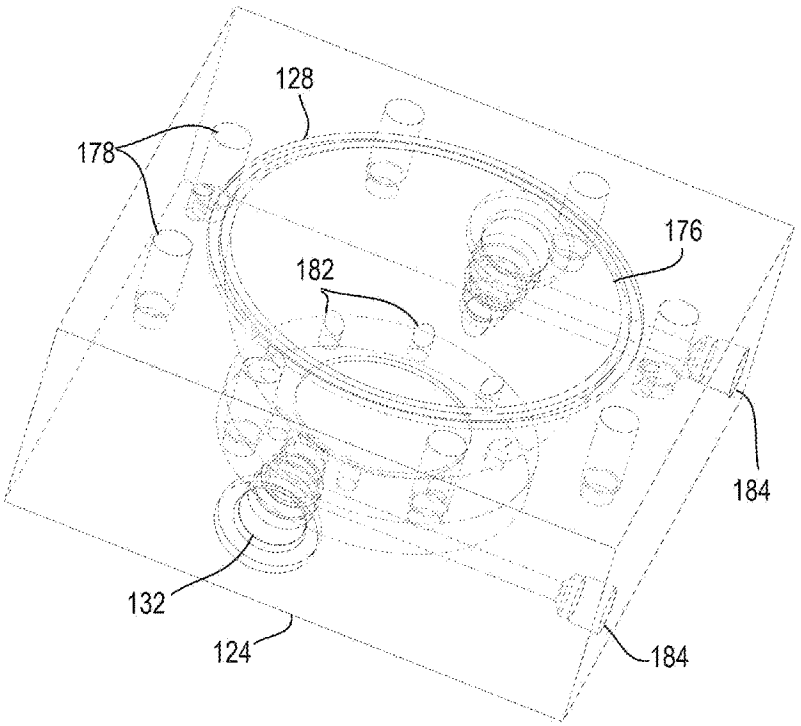
FIG. 12 is a hidden line view of FIG. 11.
Figure 11:
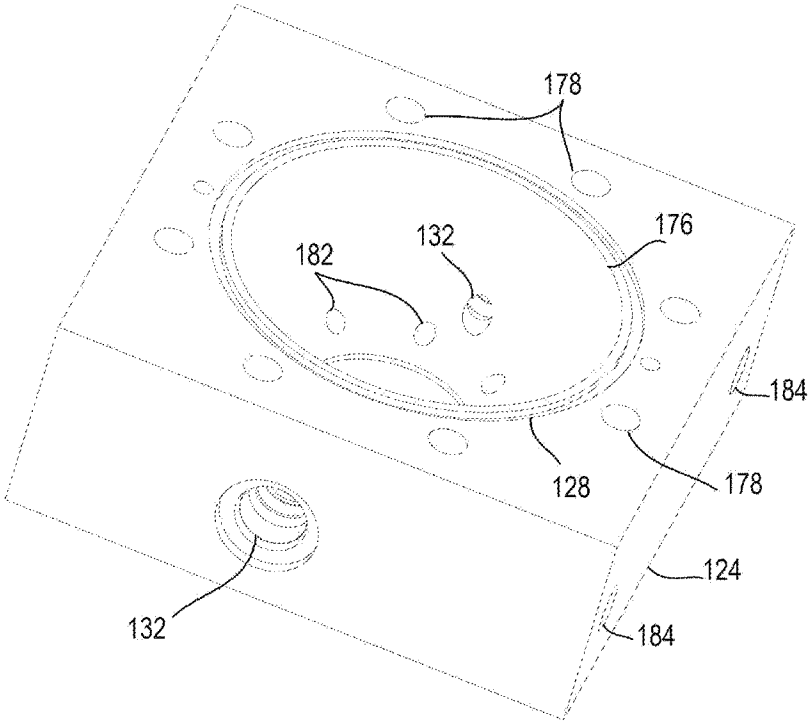
FIG. 11 is a top isometric view of the lower housing component shown in FIG. 7.

Looking to FIG. 11 and hidden line FIG. 12, the lower housing component 124 is shown with the upper housing component 122 and rotor assembly 180 removed along with the check valve 134. In these views, threaded voids 178 can be seen quite clearly as configured for receiving a threaded portion of fasteners 126. Likewise, clearance voids 182 are shown allowing for passage of fasteners 146. Also shown are fluid ports 184. These fluid ports allowed fluid communication to ports 132 at a position adjacent check valves 134 which allow one way passage of fluids with the chamber 164 previously discussed.

FIG. 10 also shows a lower bearing 196 which is held in place by a bearing keeper 198. The bearing keeper 198 engages a channel 194 as seen in FIGS. 21-23.

Figure 14:
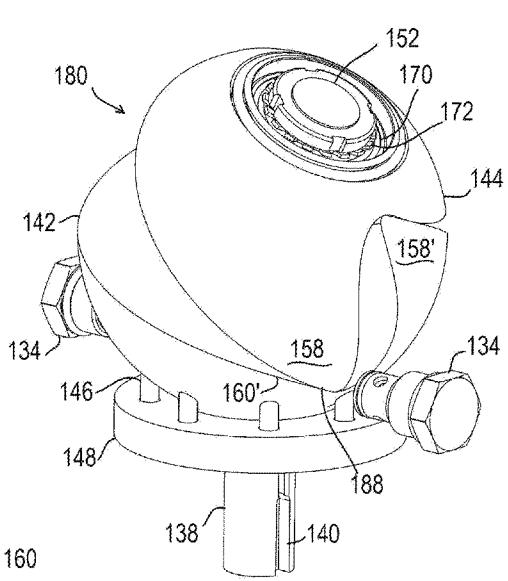
FIG. 14 is a side isometric view of the example of FIG. 13 from a different angle.
Figure 15:
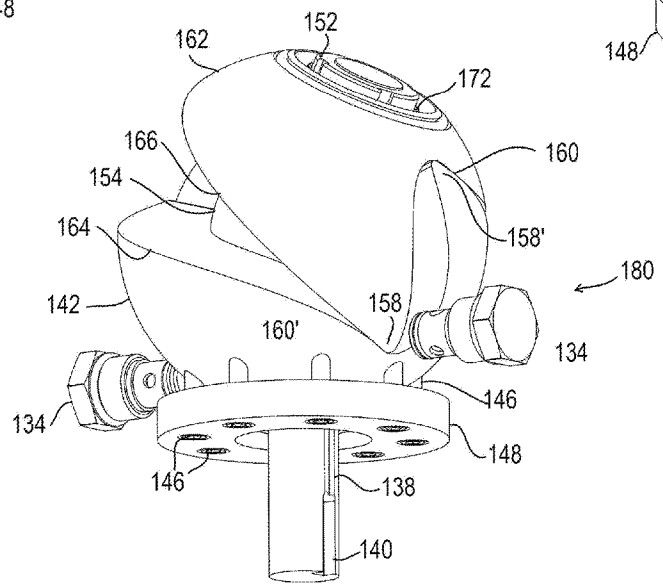
FIG. 15 is a bottom isometric view of the example of FIG. 13.
Figure 13:
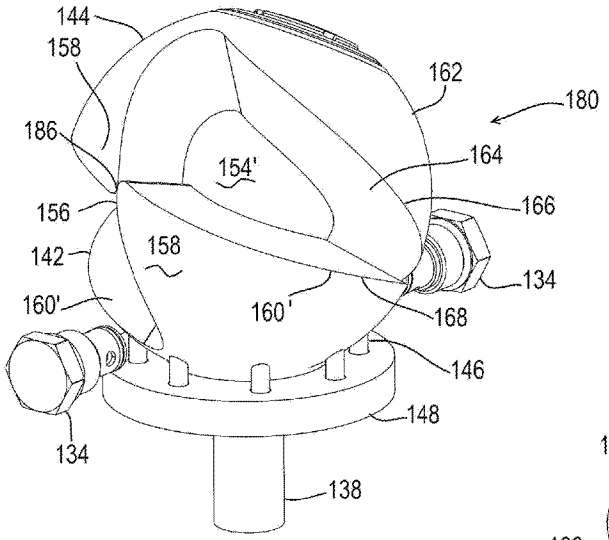
FIG. 13 is a side isometric view of a rotor assembly such as may be used in the example of FIG. 7.

FIGS. 13-15 show the rotor assembly 180 and check valves 134 removed from the housing 122. Also shown in these views are the rotor 144, stator 142, shaft 138, stability ring 148, and fasteners 146. One seal point 186 is shown between the rotor 144 and stator 142. In the rotor position of FIG. 13 this seal point 186 is accomplished where the lobe 158 of the rotor 144 seals with the lobe 158' of the stator 142. In this disclosure, components of the stator having similar components on the rotor will be denoted with an apostrophe ('). For example, the lobe 158 of the rotor is similar to (and in some applications is substantially identical to) the lobe 158' of the stator. In FIG. 14, the opposing circumferential side of the rotor assembly 180 is shown in the same nutational position. At this side a seal point 188 is seen between the lobe 158 of the rotor 144 and the valley 160' of the stator 142. While the term "seal point", is used herein, actual face-to-face contact may not be achieved between the surfaces. A very slight interference gap (fluid seal) may be provided between the surfaces in some applications. In other applications, the rotor 144 and or stator 142 may be formed slightly oversized, upon which nutation of the rotor 144 relative to the stator 142 and potentially inner surface 176 of the housing 120 results in an initial wear-in of the surfaces similar to common piston engines. This will result in substantially no gap between the surfaces once the "wear-in" period is completed. The relative movement of the rotor 144 relative to the stator 142 will be disclosed in more detail.

Looking to FIGS. 16-20 the rotor is shown removed from the other components to show the surfaces thereof including the lobes 158, and valleys 160. It is to be understood that the opposing and cooperating stator may have similar or substantially identical lobes and valleys forming the face of the stator. In addition, an inner substantially cylindrical surface 192 is provided for contact with the bearing 170 and bearing keeper 172.

Figure 23:
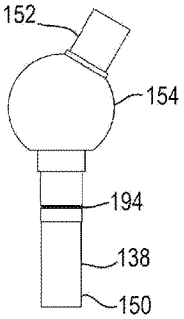
FIGS. 21-23 show a bent axis rotor such as may be used in the example of FIG. 8.
Figure 21:
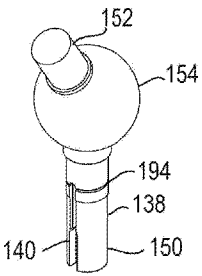
Figure 22:
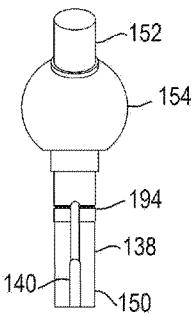

FIGS. 21-23 show one example of a bent shaft 138. This bent shaft 138 may be used with the other components shown herein in several combinations. These figures clearly show the spherical surface 154 positioned between the upper portion 152 and the lower portion 150. In addition, the thread 194 for the bearing keeper or lock nut to be tightened 196 can clearly be seen.

Figure 27:
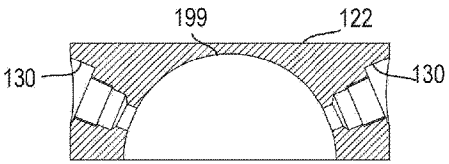
FIG. 27 is a cutaway view taken along line 27-27 of FIG. 26.
Figure 29:
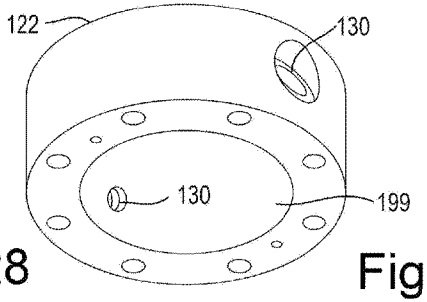
FIG. 29 is a bottom isometric view of the upper housing component of FIG. 24.
Figure 24:
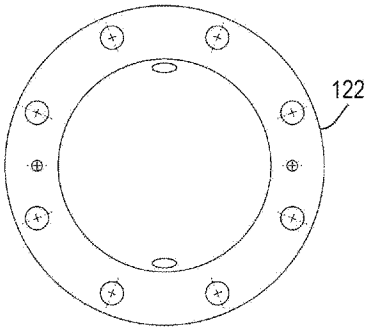
FIG. 24 shows a bottom view of the upper housing component shown in FIG. 7.
Figure 26:
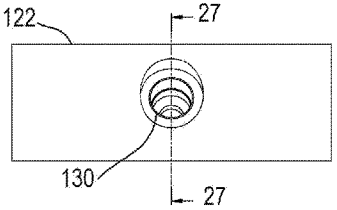
FIG. 26 is a front view of the upper housing component of FIG. 24.
Figure 28:
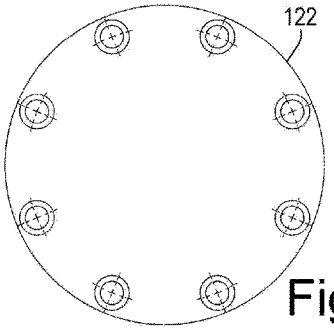
FIG. 28 is a top view of the upper housing component of FIG. 24.

FIGS. 24-29 show one example of the upper housing component 122. In FIG. 27, the ports 130 and the substantially spherical inner surface 199 which may be contiguous with surface 176 can be clearly seen.

Figure 31:
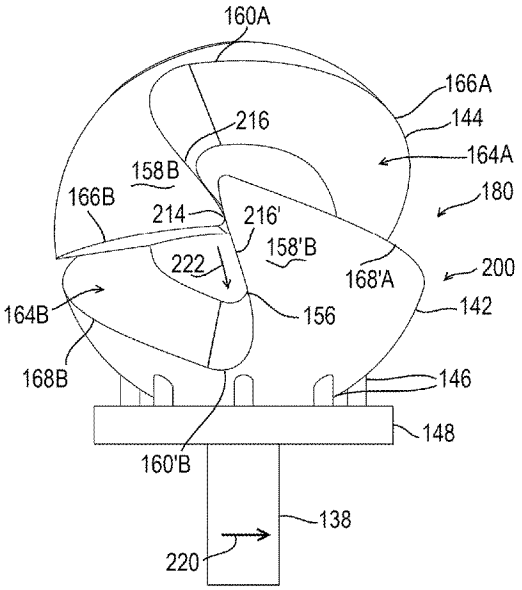
FIG. 31 is a side view of the example of FIG. 30 with the rotor in the first rotational position.
Figure 30:
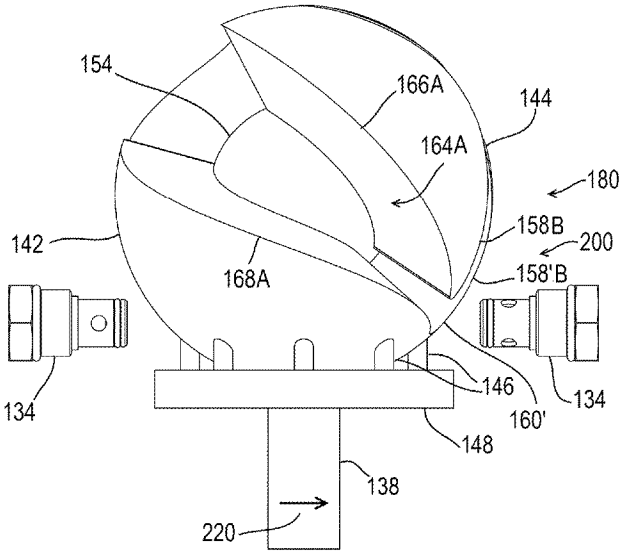
FIG. 30 is a front view of one example of the disclosed the stator, and rotor in a first position.
Figure 32:
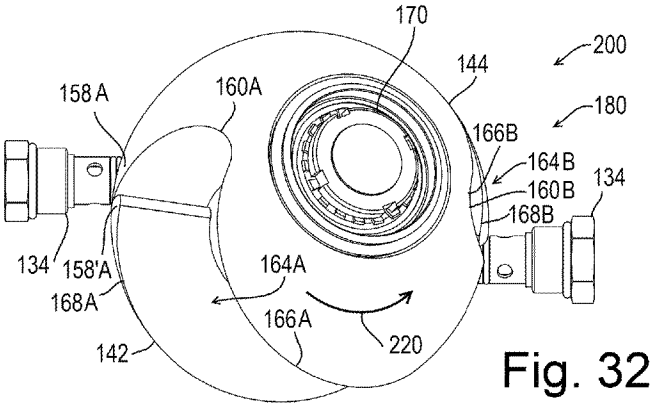
FIG. 32 is a top view of the example of FIG. 30 with the rotor in the first rotational position.
Figure 34:
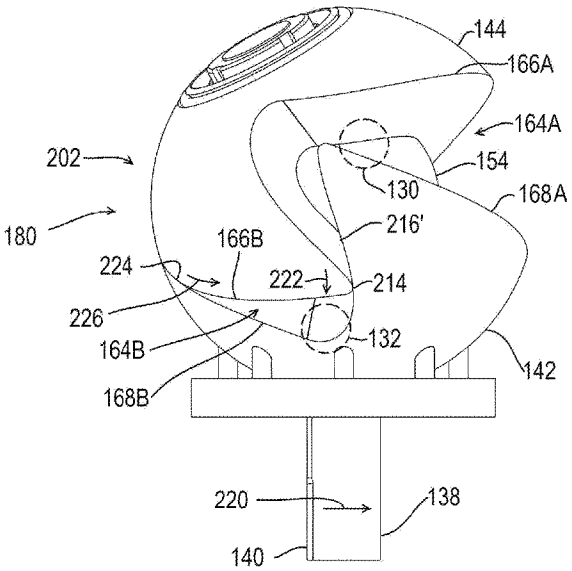
FIG. 34 is a side view of the example of FIG. 30 with the rotor in the second rotational position.
Figure 33:
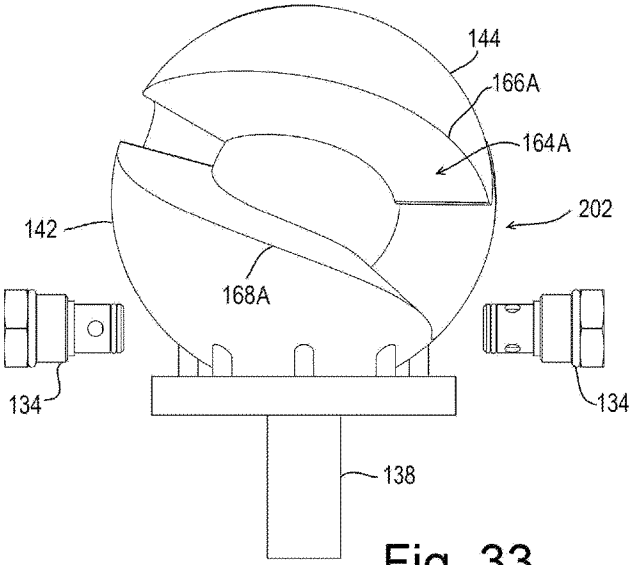
FIG. 33 is a front view of one example of the disclosed stator, and rotor in a second rotational position.
Figure 35:
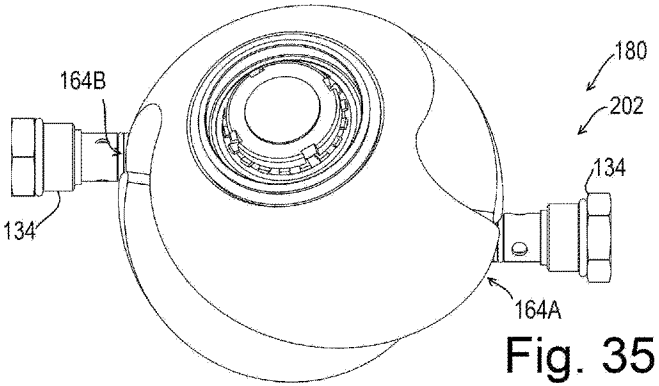
FIG. 35 is a top view of the example of FIG. 30 with the rotor in the first rotational position.
Figure 37:
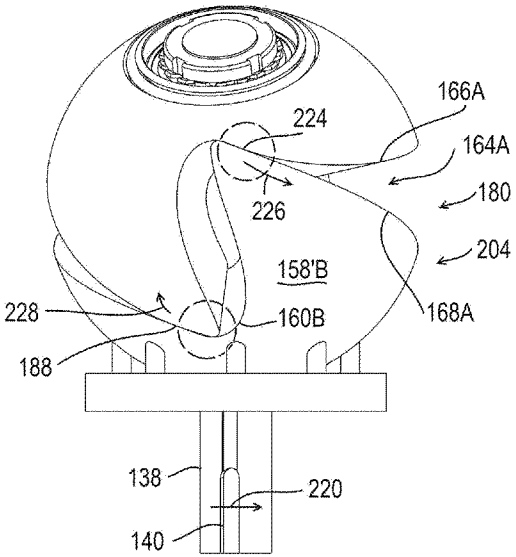
FIG. 37 is a side view of the example of FIG. 30 with the rotor in the third rotational position.
Figure 36:
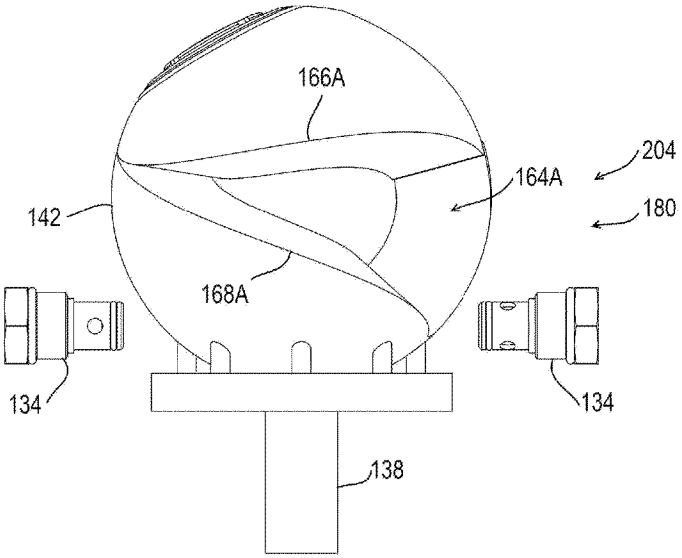
FIG. 36 is a front view of one example of the disclosed the stator, and rotor in a third rotational position.
Figure 38:
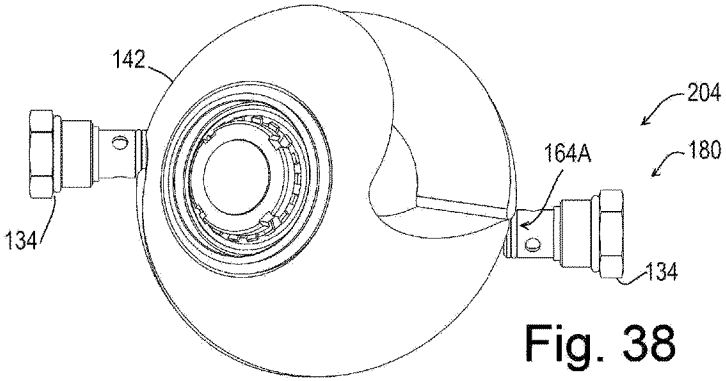
FIG. 38 is a top view of the example of FIG. 30 with the rotor in the third rotational position.
Figure 40:
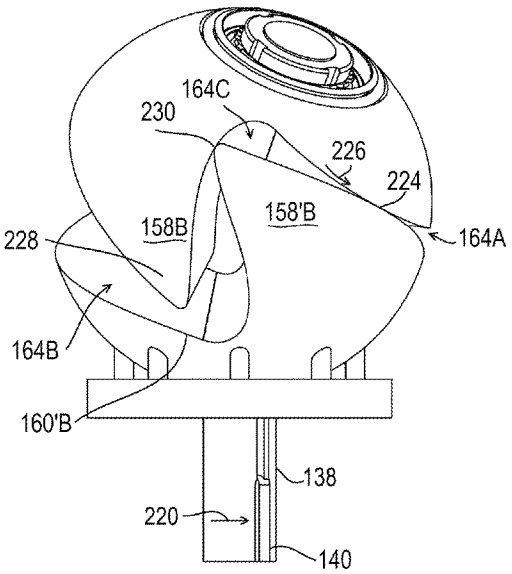
FIG. 40 is a side view of the example of FIG. 30 with the rotor in the fourth rotational position.
Figure 39:
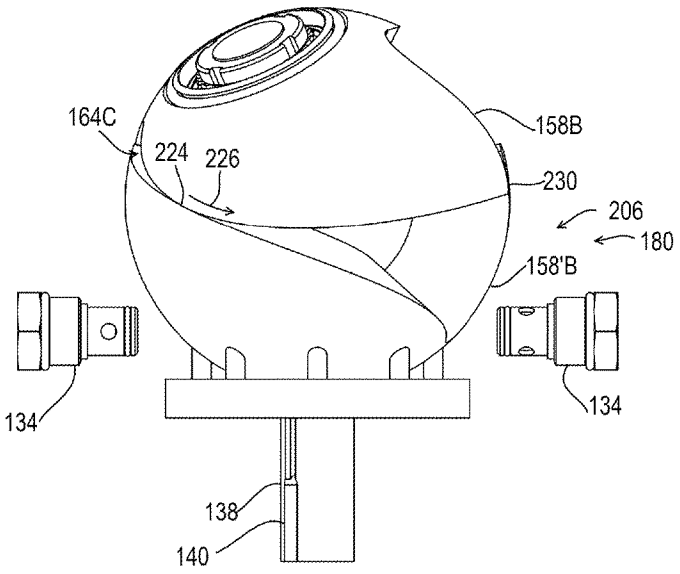
FIG. 39 is a front view of one example of the disclosed the stator, and rotor in a fourth rotational position.
Figure 41:
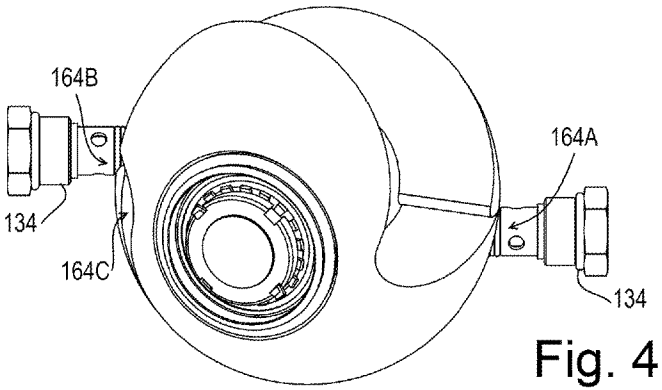
FIG. 41 is a top view of the example of FIG. 30 with the rotor in the fourth rotational position.
Figure 43:
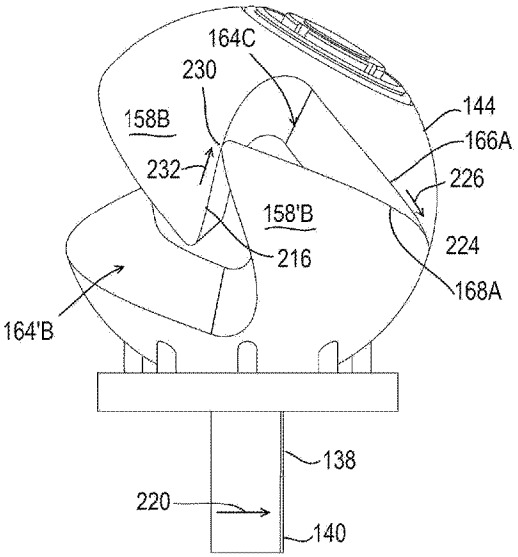
FIG. 43 is a side view of the example of FIG. 30 with the rotor in the fifth rotational position.
Figure 42:
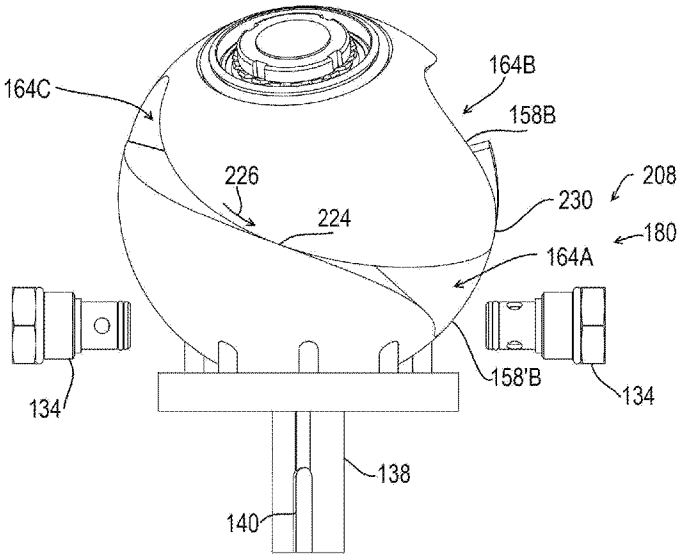
FIG. 42 is a front view of one example of the disclosed the stator, and rotor in a fifth rotational position.
Figure 44:
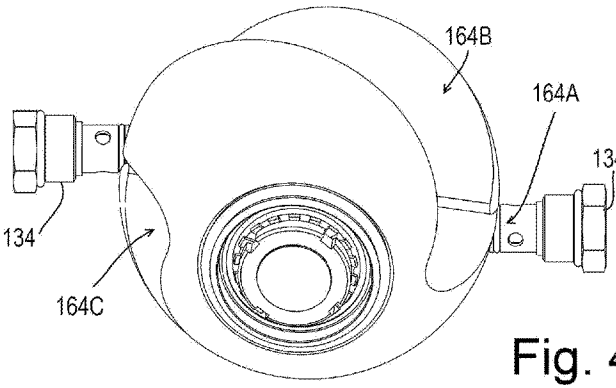
FIG. 44 is a top view of the example of FIG. 30 with the rotor in the fifth rotational position.
Figure 46:
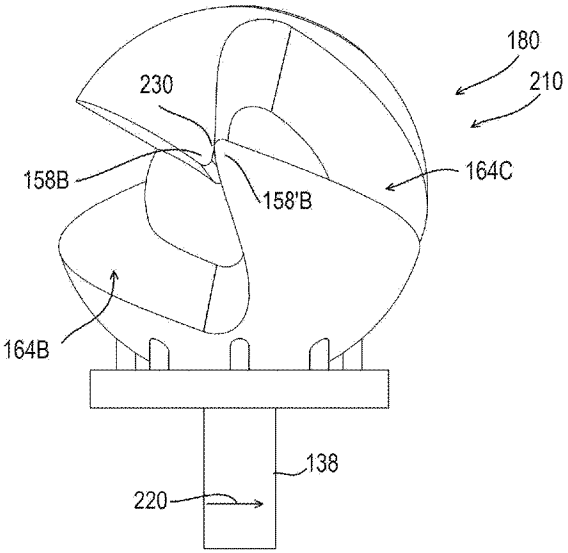
FIG. 46 is a side view of the example of FIG. 30 with the rotor in the sixth rotational position.
Figure 45:
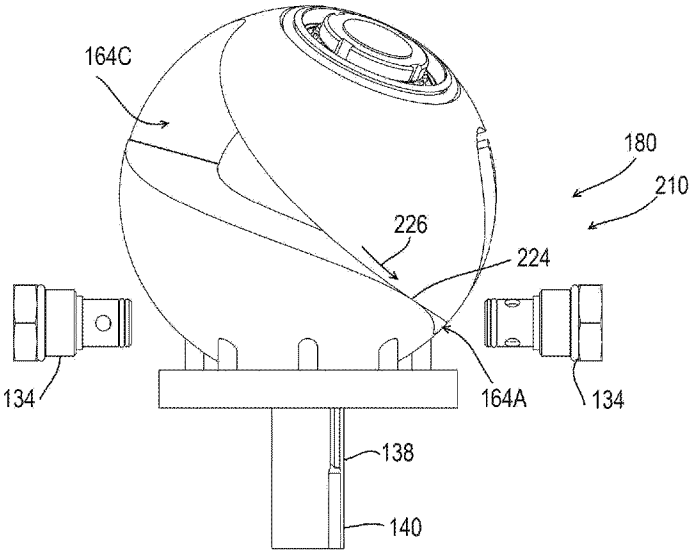
FIG. 45 is a front view of one example of the disclosed the stator, and rotor in a sixth rotational position.
Figure 47:
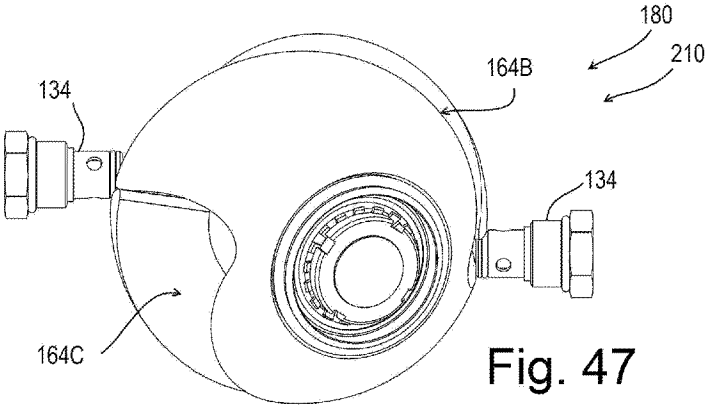
FIG. 47 is a top view of the example of FIG. 30 with the rotor in the sixth rotational position.
Figure 49:
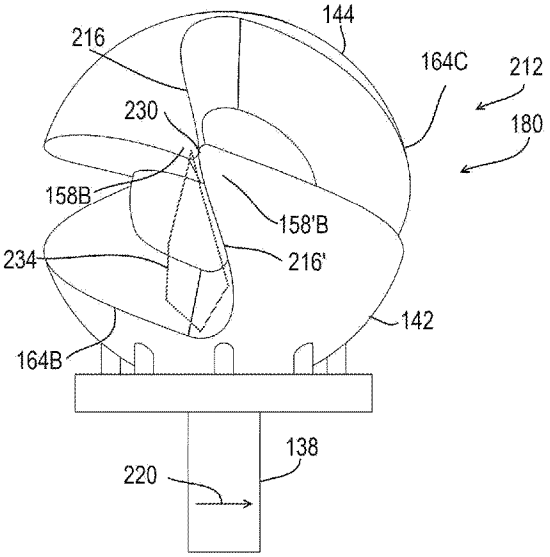
FIG. 49 is a side view of the example of FIG. 30 with the rotor in the seventh rotational position.
Figure 48:
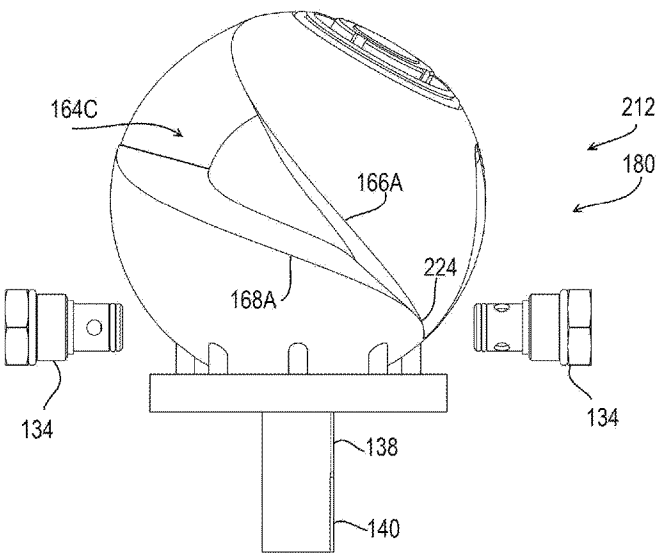
FIG. 48 is a front view of one example of the disclosed the stator, and rotor in a seventh rotational position.
Figure 50:
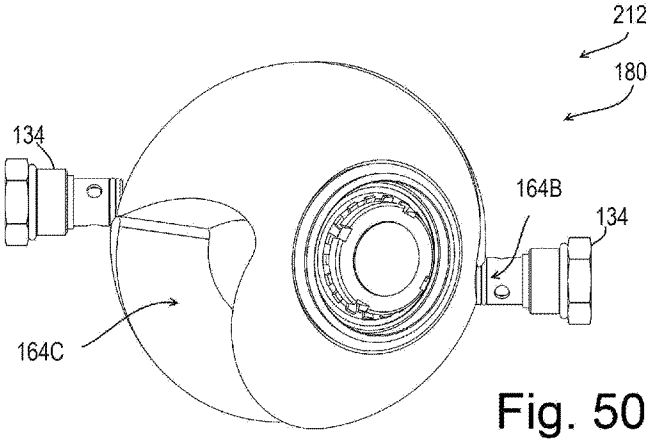
FIG. 50 is a top view of the example of FIG. 30 with the rotor in the seventh rotational position.

FIGS. 30-50 show the rotor assembly in several nutational positions. Each position is shown in three views so that for example FIGS. 30-32 show the rotor 144 in a first position 200 relative to the stator 146 and attached components. FIGS. 33-35 show the stator 146 from the same relative position, but where the rotor 144 and attached components are in a second nutational position 202. Likewise, FIGS. 36-38 show a third nutational position 204, FIGS. 39-41 show a fourth nutational position 206, FIGS. 42-44 shown a fifth nutational position 208, FIGS. 45-47 show a sixth nutational position 210, and FIGS. 48-50 show a seventh nutational position 212. Following the seventh nutational position 212, the rotor 144 will generally nutate to the first position 200, and the nutational cycle will repeat. In FIGS. 31, 34, 37, 40, 43, 46, and 49, the check valves 134 are not shown so that the stator 142 and rotor 144 can be more clearly seen.

Figure 54:
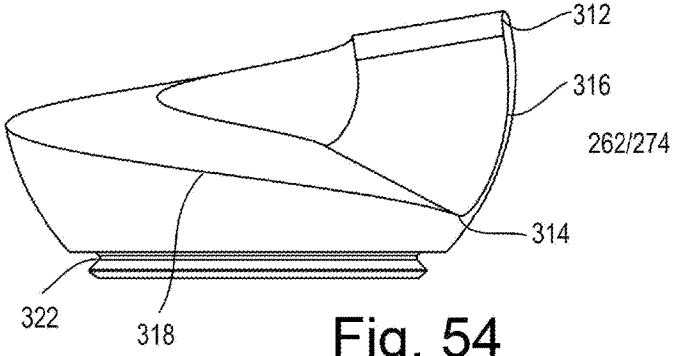
FIG. 54 is a side view of one example of a rotor such as shown in FIG. 52. A cooperating stator in one example will have lobes and valleys forming substantially an identical surface (face) as the rotor depicted here.
Figure 63:
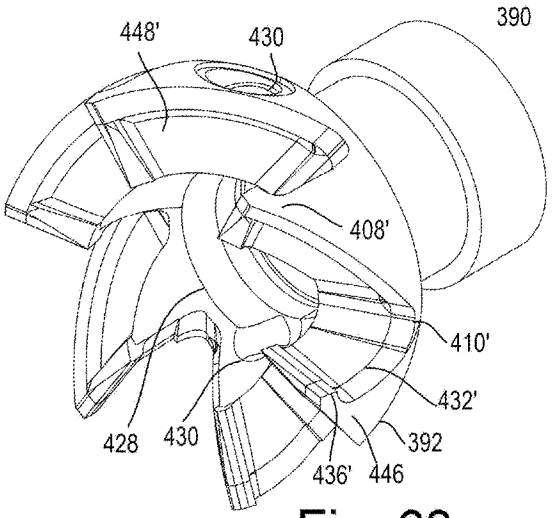
FIG. 63 is a top isometric view of the stator component shown in FIG. 62.
Figure 76:
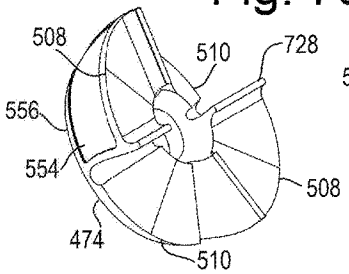
FIG. 76 is a top isometric view of the rotor component shown in FIG. 74.
Figure 75:
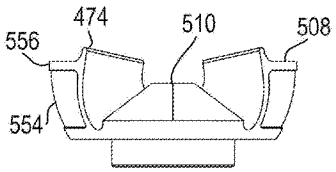
FIG. 75 is a side view of the rotor component shown in FIG. 74.
Figure 74:
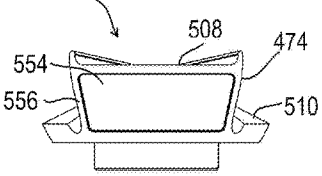
FIG. 74 is a front view of a rotor component such as shown in FIG. 73.

FIGS. 30-50 show a rotor 144 and stator 142 each with two lobes 158(A-B)/158'(A-B) and two valleys 160(A-B)/160'(A-B) although other configurations can also be utilized such as the single lobe example shown in FIG. 54, the six lobe example of FIG. 63, or the four lobe example shown in FIG. 76. In this disclosure, where there are similar sub-components on a parent component, specific sub-components may be denoted with a letter suffix. For example, lobes 158A and 158B are both on the rotor 144, but on generally opposing circumferential sides.

The relative seal locations/positions between the stator 142 and rotor 144 will now be disclosed in reference to the rotational cycle shown in FIGS. 30-50. While each drawing only shows one side of the rotor assembly 180, it can be appreciated that in this example, seal points are formed on opposing sides of the rotor assembly 180. These two seal points form chambers 164A/164B on either circumferential side of the rotor assembly 180.

Looking to FIGS. 30-32, a seal point 214 is shown between the axial face 216 of the stator 142 and an opposing axial face 216 of the rotor 144. For reference, the axial faces 216 and 216' generally correspond to the contact faces (24) of U.S. Pat. No. 5,755,196 (196) while the upper surfaces 168 of the stator and lower surfaces 166 of the rotor 144 generally compare to the side of faces 26 of the '196 patent. As will be understood there are significant differences between the rotors and stators of this disclosure and those rotors disclosed in the '196 patent. One difference is seen in that sealing may be accomplished between the facing surfaces 166/168 of the rotor and stator as well as between the axial faces 216/216' of facing lobes of the rotor and stator.

Looking to FIG. 31, it can be seen how a seal point 214 is formed between the rotor 144 and the stator 142. As the shaft 138 rotates in the direction indicated at direction 220, the rotor 144 will roll slightly resulting in only a slight repositioning of the seal location 214A along the axial face 216 of the rotor 144. Due to the relative movement of the nutating rotor 144, the seal point 214 will move/slide significantly down the axial face 216' of the stator in direction of travel 222. Sealing will be maintained between the surfaces as understood by looking to FIG. 34 where the volume of the chamber 164A is substantially reduced as the seal location 214 has repositioned substantially down the axial face 216.

In addition, a seal point 224 may form between surfaces 166 and 168 as can be seen in FIGS. 33-35. As the rotor 144 nutates, the seal point repositions in direction of travel 226 as surface 166B engages in substantially rolling contact with surface 168B, further reducing the volume of chamber 164B. The chamber 164 sealed on one side by the seal point 214 and on the other side by the seal point 224 is adjacent to and in fluid contact with the port 132. The chamber 164B is defined then by the lower surface 166B, the upper surface 168B, the spherical surface 154, and the inner surface 176 (see FIG. 12) of the housing 120. As the rotor 144 continues to nutate, the seal point slides down the axial face 216' in direction of travel 222 and the chamber 164 continues to reduce in volume forcing fluid out of the port 132. At the same time, the chamber 164A on the opposing side of the rotor assembly 180 increases in volume, drawing more fluid there into, in one example through port 130. In this example, the port 130 is positioned adjacent the upper surface 168A for inflow of fluids into the adjoining chamber.

Looking to FIGS. 36-38, it can be seen that the chamber 164B has reduced to a zero volume as seal points 214 and 224 coalesce at seal point 188. In this position, it can also be seen that surface 166A has formed a new seal point 224/230 therebetween. Seal point 224/230 bifurcates and moves in two opposing directions once formed. Seal point 224 moves direction 226 as previously discussed, while seal point 230 moves in the opposing direction. A chamber 1640 is formed therebetween in fluid communication with one of the upper ports 130 to allow fluid thereinto. The lobe 158B of the rotor repositions away from valley 160B in direction of travel 228. This allows fluid flow past the lobe 158.

Looking to FIGS. 39-41, it can be seen that the seal point 224 has repositioned in direction 226 towards the lobe 158'B, and the seal point 230 has repositioned in a rolling/sliding manner towards the point of lobe 158'B. Lobe 158B continues to move away from valley 160B, as chamber 164A continues toward a minimum volume position, and chamber 164B continues toward a maximum volume position. Chamber 164C continues to increase in volume, drawing fluid into the apparatus through port 130.

Looking to FIGS. 42-44, it can be understood that as the rotor 144 continues to nutate, seal point 224 continues in direction 226 through rolling contact between the face 166A of the rotor 144 and face 168A of the stator 142 as previously described. The volume of the chamber 1645 continues to increase, and the volume of the chamber 164A continues to decrease. In this example, fluid continues to flow into the chamber 1640 through the adjacent port 130, and fluid continues to flow out of chamber 164B through the adjacent port 132. Lobe 1585 continues in relative motion direction 232 while the seal point 230 slides down axial face 216.

Looking now to FIGS. 45-47, the seal point 230 approaches the tips of both lobes 158*b* and 158'B as the chamber 164B approaches the maximum volume position and opposing chamber 164A approaches a minimum volume position. Chamber 1640 continues to increase and draw fluid thereinto.

FIGS. 48-50 the last stage of the cycle is shown, where chamber 164B has reached a maximum volume position, and chamber 164A has reached a minimum volume position, dispelling substantially all of the fluid therein. Seal point 230 has reached the points of lobes 158B and 158'B. Immediately past this position, surfaces 166A and 168A separate, opening seal point 224 as can be seen looking to FIG. 30. Chamber 1640 is then open to lobe 158'B and becomes the new chamber 1645 shown in FIG. 31. The cycle then repeats for each revolution of the shaft 138.

FIGS. 30-50 show that the distal tip of lobe tip 1588 of the rotor 144 scribes a substantially teardrop shaped path 234 in each cycle of nutation. Therefore, in this example the axial face 216' of the lobe of the stator 142 as well as the axial face 216 of the rotor 144 may also form a substantially teardrop shape in cooperation with the adjacent valley to allow a seal therebetween as the volume of the adjacent chamber decreases in a compressor (pump) application, or increases in an expander application. As previously discussed, the seal may be a fluid seal, or a sliding contact seal between these surfaces. In other examples, other shapes may be utilized such as the shape shown in FIGS. 63-64. It should be noted that the path 234 presented in FIG. 49 shows straight lines interconnecting the specific positions of the lobe tip shown in FIGS. 31, 34, 37, 40, 43, 46 and 49. It can be understood that the actual path of the lobe tip will be arcuate following the nutation progression of the rotor 144, and generally not linear segments.

Looking to FIG. 51, another example of a housing 240 is shown. In this example the housing 240 comprises an upper housing 242 and a lower housing 244. The upper housing 242 of this example comprises a port 246 which may have a threaded surface 248 for connection of a check valve or other fluid connection as previously discussed. Similarly, the lower housing 244 comprises a port 250 which may also have a threaded surface 252 for connection of a check valve or other fluid connection. Also be appreciated that the example shown in FIG. 51 comprises a shaft 254 having a keyway 256 each protruding from the housing 240 for attachment of an engine, motor, or driven shaft. It can also be appreciated that the port 250 is offset 258 from a plane passing through the axis 260 of the shaft 254 in the center of the port 246. A similar example is shown and described relative to FIG. 9.

Looking to FIG. 52, the housing 240 is shown cut along line 52-52 of FIG. 51 such that the port 246 is shown however, only a small portion of the port 250 is shown. As with prior examples, in this example a rotor 262 is shown having a generally spherical outer surface 264. The apparatus also comprises a stator 266 fixed to the lower housing 244 through a plurality of fasteners equivalent in function to the fasteners 196 previously discussed in reference to FIG. 8. These fasteners pass through clearance holes 268 and are received by threaded surfaces 270 in the stator 266. A static seal 272 may be provided to prohibit fluid flow outward between the upper housing 242 and lower housing 244. Likewise, static seal 274 is disposed between the stator 266 and the lower housing 244 to seal there between. Seals 276 may also be provided between the stator 274 and the shaft 254. To reduce friction and maintain alignment, a shaft bearing 278 may be provided between the housing 254 or stator 274 and the shaft 254. A bearing keeper 280 may also be provided and engage a thread 282 in the shaft 254. A similar keeper 284 may be provided at the opposing end of the shaft 254 as shown in FIG. 53. The keeper 294 in one form engages a channel 286 in a shaft 254. In this example, the shaft 254 is a straight, or through shaft, and not a bent shaft such as the bent shaft shown in FIG. 10.

FIG. 53 shows a detail view of the upper interior portion (region 53) of the housing 240. As shown, a precession cam 288 is shown as engaging a keyway 290 such as by application of a key 292 between a keyway formed in the precession cam 288 and the keyway 290 of the shaft 254 in a manner well-known in the art. A seal 294 may be provided between the surface of the rotor 262 and the inner surface 296 of the upper housing 240 to prohibit or reduce fluid flow there between. As the precession cam 288 rotates with the shaft 254, and as the rotor 262 is prohibited from substantial rotation by engagement of the lobes of the rotor 262 engaging the lobes on the stator 274, the rotor 262 will nutate about the surface of the stator. A bearing 298 may be provided between the precession cam 288 and the rotor 262 to reduce friction there between. Additionally, an eccentric cap 300 may be positioned between the precession cam 288 and the keeper 284. To prohibit or reduce fluid flow between components, seals 302, 304, and 306 may be provided between the surfaces adjacent thereto.

As the shaft 254 is not centered upon the axis 308 of the precession cam 288, and whereas there is an alpha ($\alpha$) angle 310 between the axis 260 of the shaft 254 and the axis 288 of the precession cam 288, the rotor 262 will nutate about the stator 274 in a manner substantially equivalent to that shown in the previous examples.

Figure 55:
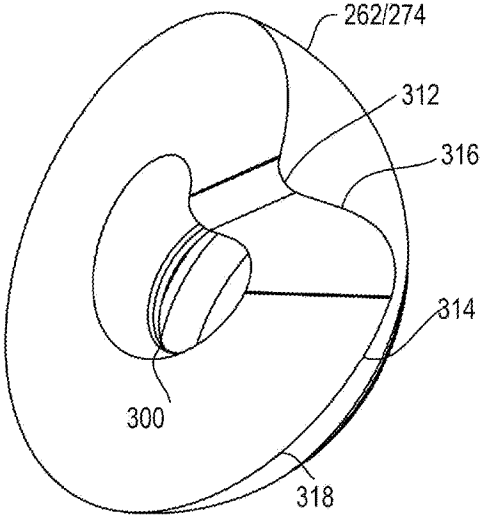
FIG. 55 is a top isometric view of the rotor shown in FIG. 54.
Figure 56:
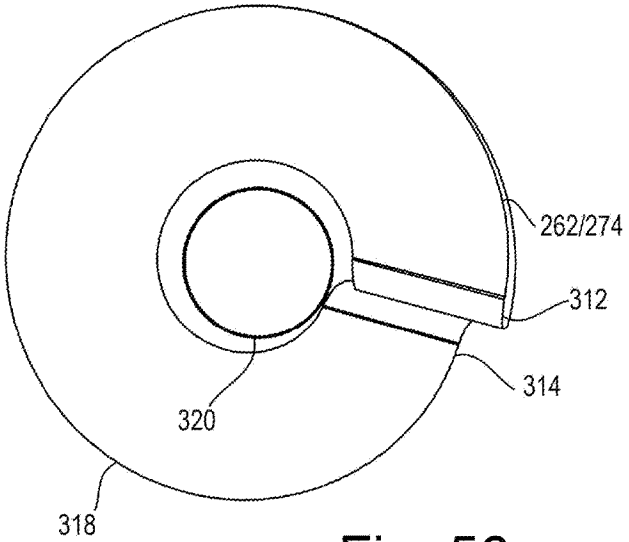
FIG. 56 is a top view of the rotor shown in FIG. 54.

FIGS. 54-56 show a rotor/stator 262/274 with surfaces very similar to those shown in FIGS. 16-20 such as a lobe 312 adjacent a valley 314. The lobe 312 comprises an axial face 316 similar to the axial face 216 of FIG. 16 and side face 318 similar to the face 168/166 of FIG. 16. In addition, a surface 320 is formed to engage the shaft 254 when the component is used as a stator or to engage the precession cam 288 when used as a rotor. While this example uses a single lobe rotor/stator, the relative motion of a rotor of this design to a stator of this design is substantially equivalent to that discussed in reference to FIGS. 30-50 wherein a teardrop motion is encountered by the rotor 262 relative to a stator 274. As with the previous example, the axial face 316 of lobe 312 of the rotor/stator engages in sliding contact with the axial face 316 of the opposing stator/rotor and the side face 318 of the rotor/stator engages in substantially rolling contact with the side face 318 of the opposing stator/rotor. This contact has been well discussed in reference to FIGS. 30/50 and need not be substantially repeated. A channel 322 may be provided for contact with the seal 294 previously disclosed. When the lobe and valley configuration shown in FIGS. 54-56 is utilized as a stator 274, the channel 322 and associated components may be replaced by structures more easily understood by looking to FIG. 52.

As with the examples shown elsewhere in this disclosure, including those depicted in FIGS. 16-20, the axial face of the rotor 262 and/or stator 274 may be a teardrop shape as previously discussed, while the surface 318 may be a spherical involute surface. Such surfaces are disclosed in applicant's prior patents and patent applications which are publicly available.

Figure 57:
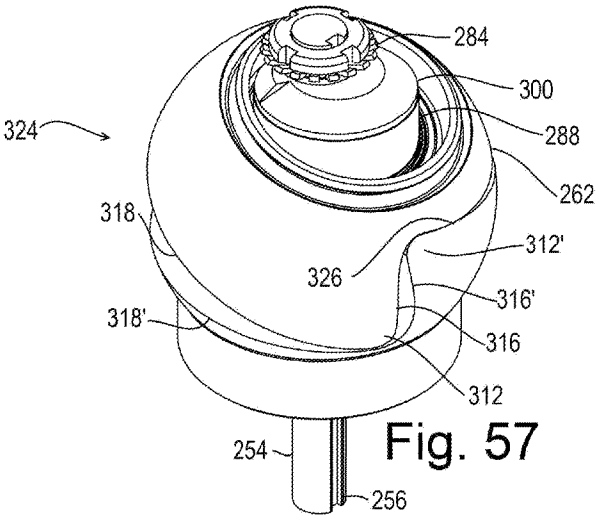
FIG. 57 is a top isometric view of a rotor-stator assembly such as may be used in the example of FIG. 52.
Figure 60:
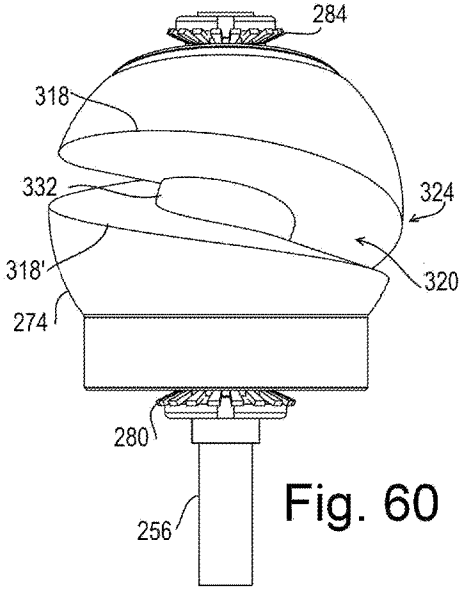
FIG. 60 is a rear view of the rotor-stator assembly shown in FIG. 57.
Figure 59:
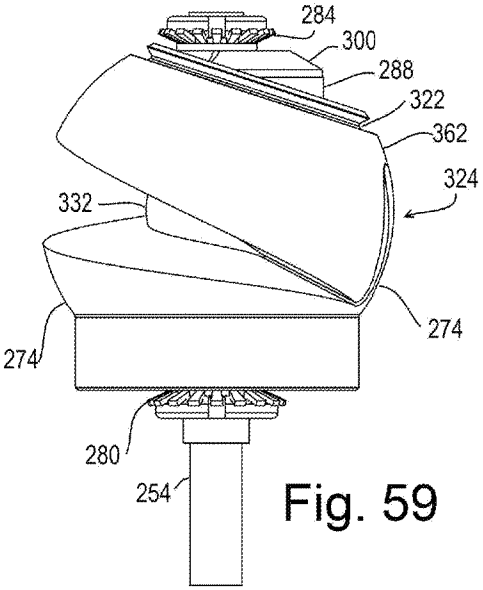
FIG. 59 is a side view of the rotor-stator assembly shown in FIG. 57.
Figure 58:
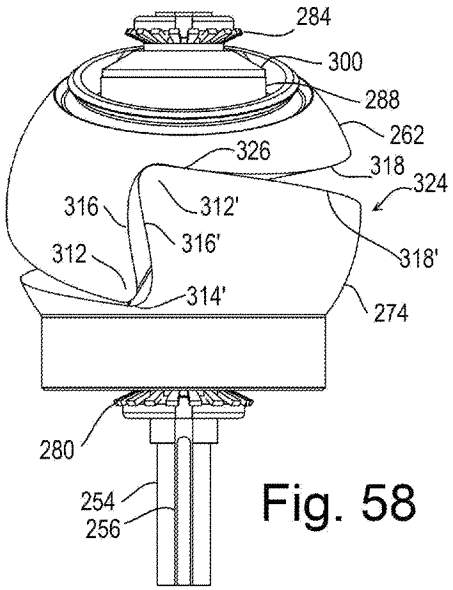
FIG. 58 is a front view of the rotor-stator assembly shown in FIG. 57.

FIGS. 57-60 generally show a rotor-stator assembly utilizing the through shaft 254 and other components of FIG. 52. FIG. 57 generally shows an isometric view wherein the rotor 262 seals with the stator 274 at seal point 326 to prohibit fluid flow therebetween. In the face view of FIG. 58, the seal point 326 can be seen between side faces 318 and 318'. The lobe 312 of the rotor 262 has repositioned slightly away from the valley 314' in a position similar to the fourth position shown in FIG. 40 of a two-lobe assembly. FIG. 59 generally shows the same surfaces in the same relative positions however the angle of view of the assembly is slightly rotated. Likewise, FIG. 60 shows a view at 180° opposition circumferentially from that shown in FIG. 58 and shows a relatively large portion of a chamber 320 formed by the rotor 262, stator 274, central ball surface 332 of the shaft 256, and the inner surface 296 of the housing 240. The surface 296 of the housing 240 is not shown in this drawing but is shown quite clearly in FIGS. 52 and 53. It can be appreciated that as the rotor 262 nutates, the volume of the chamber 330 increases and decreases in size as previously described in some detail.

Another example of the disclosed apparatus is shown in FIGS. 61-71. This example utilizes a different shaft assembly, novel porting, and a unique housing assembly as well as other novel features. Looking to FIG. 61 the device is shown comprising a housing 350 which in turn generally comprises an upper housing component 352 and lower housing 354 held in place by way of a plurality of fasteners 356. In one form, an upper plate 358 having a port 360 is used to complete the inner chamber 362 and seal the components therein. A port 364 may be provided through the housing 350 wherein the port 364 cooperates with the port 360 to allow for fluid flow through the apparatus as a pump (compressor) in a first direction or as an expander in a second direction. As with the ports previously disclosed, the ports 360 and 364 may utilize threaded surfaces 366/368 respectively for attachment of check valves or other fluid couplings. As with the previous examples, a main shaft 370 may extend outward of the housing 350.

Figure 62:
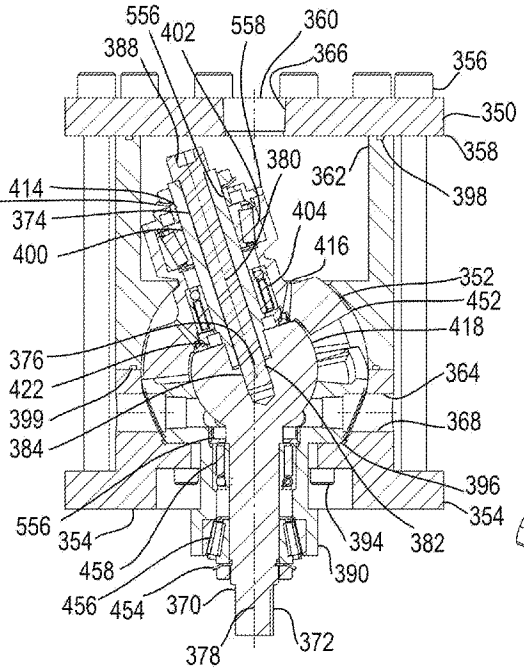
FIG. 62 is a cutaway view taken along like 62-62 of FIG. 61.
Figure 61:
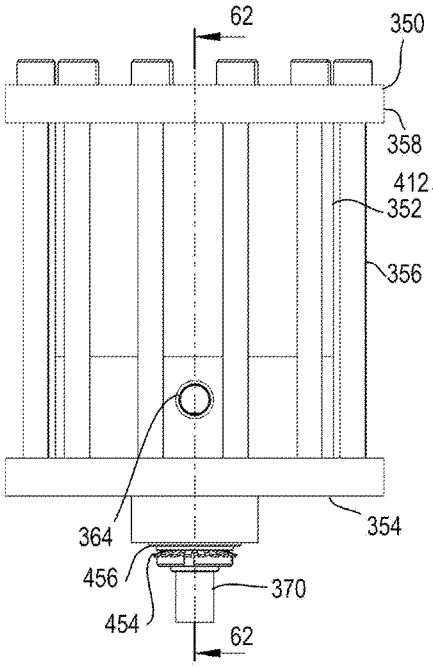
FIG. 61 is a front view of an example of the disclosed apparatus including a housing and shaft.
Figure 70:
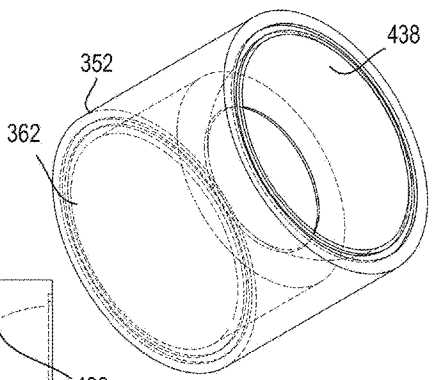
FIG. 70 is an isometric hidden line view of the housing component shown in FIG. 69.
Figure 69:
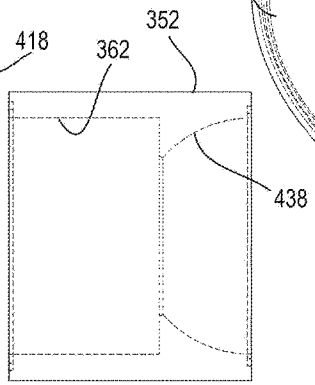
FIG. 69 is a side hidden line view of an upper housing component as shown in FIG. 62.
Figure 71:
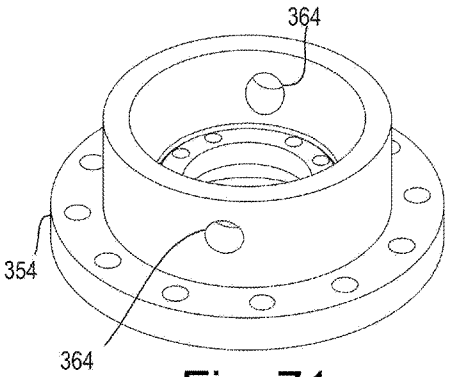
FIG. 71 is a top isometric view of the lower housing component shown in FIG. 62.
Figure 65:
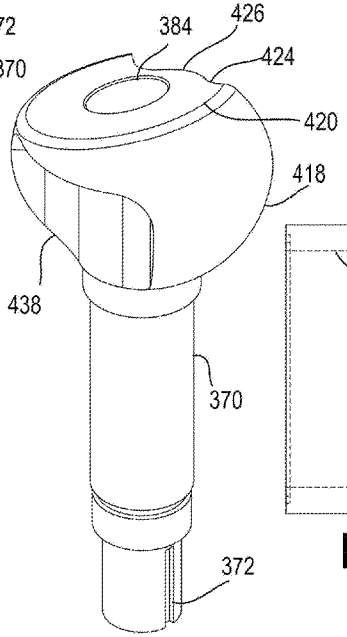
FIG. 65 is an isometric view of the shaft and ball component shown in FIG. 62.
Figure 66:
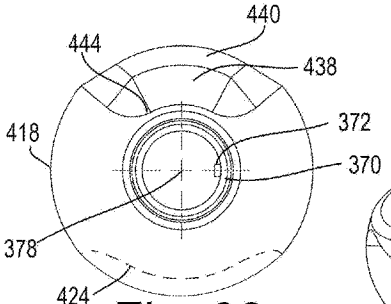
FIG. 66 is a bottom view of the shaft and ball component shown in FIG. 62.
Figure 68:
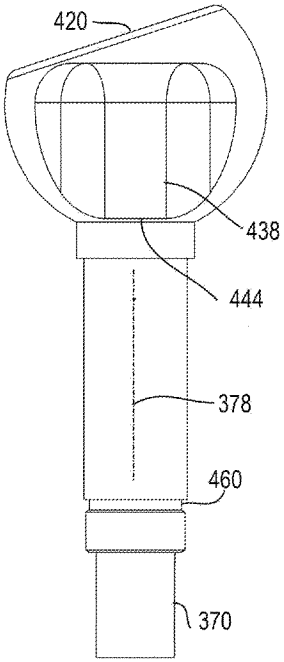
FIG. 68 is a front view of the shaft and ball component shown in FIG. 62.
Figure 67:
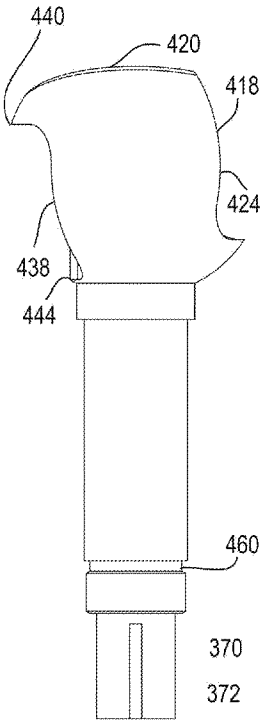
FIG. 67 is a side view of the shaft and ball component shown in FIG. 62.

Looking to FIG. 62, a cutaway view of the apparatus taken along line 62-62 FIG. 61 is shown so that the inner components can be more easily viewed. Where some of these components are difficult to view in this drawing, the reader is directed to FIG. 84 which discloses a very similar apparatus with some additional alternate components. In particular, the apparatus shown in FIG. 62 is generally a variant of the previous bent shaft examples. There are significant differences between this example and the preceding examples, for instance, while the previous bent shaft examples utilize a shaft with a unitary structure, it can be understood that the shaft assembly of this disclosure may comprise a main shaft 370 and a removably attached offset shaft 374. In one example, the collar 400 functions as the nutating shaft, and the shaft 374 is affixed to the shaft 370 as disclosed in more detail. The unitary structure shaft of the previous example, and the composite shaft of this example, are generally interchangeable. The shaft 370 in one example comprises a keyway 372 so as to facilitate the shaft 370 to be driven by an exterior engine, motor, etc. The offset shaft 374 has an axis 380 that is at an alpha ($\alpha$) angle 376 with the axis 378 of the main shaft 370. This alpha ($\alpha$) angle and the function served by engagement of the rotor 406 to the stator 392 at such an alpha ($\alpha$) angle is discussed above, and in applicant's prior patent disclosures. In one form, the offset shaft 374 has a male threaded portion 382 which threads into a female threaded portion 384 of the shaft 370 as can be understood by looking to FIGS. 65-68 to allow removable attachment thereto. In one example, shaft 374 is comprised of a threaded fastener (bolt), that passes through collar (shaft) 400 as shown also in FIG. 84. In the bolt/collar example shown, the shaft (bolt) 374 retains the upper shaft (collar) 400 in position. In one example, the collar 400 is press fit into the ball 418, and the bolt is threaded into the ball 418. It is also conceived that the bolt 374 and collar 400 are formed as a unitary shaft. The offset shaft 374 may also have a non-cylindrical portion 388 for engagement with a tightening tool such as a wrench. In the example shown, the non-cylindrical portion 388 comprises a hexagonal female fitting for acceptance of an Allen-style wrench. In other examples, the noncircular portion 388 may comprise a hexagonal or other (preferably non-cylindrical) shaped male fitting for use with standard (such as socket or open end) wrenches. Many such noncircular fittings and surfaces are known in the art.

In another example the offset shaft 374 and/or collar 400 may be interference (press) fit into the void 384 and an indexing pin may be fit through the spherical surface 418 and shaft 372, thus retaining the offset shaft 374 there within.

Returning to FIG. 62, can be seen in this example how the upper plate 350, upper housing 352 and lower housing 384 form an inner chamber 362 wherein many of the components are positioned.

In the example of FIG. 62, the shaft 370 is attached through the lower housing 354 and through a collar portion 390 of the stator 392. The stator 392 may be fastened to the lower housing 384 by way of a plurality of fasteners 394 which pass through voids in the lower housing 354 and may engage threaded portions of the stator 392. A static seal 396 may be provided between the stator 392 and the lower housing 354 to reduce or eliminate fluid flow there between. A seal 556 may be provided between the stator 392 and the shaft 370. Likewise, a static seal 398 may be provided between the plate 350 and the upper housing 352. Another static seal 399 may be provided between the upper housing 352 and the lower housing 354.

Figure 88:
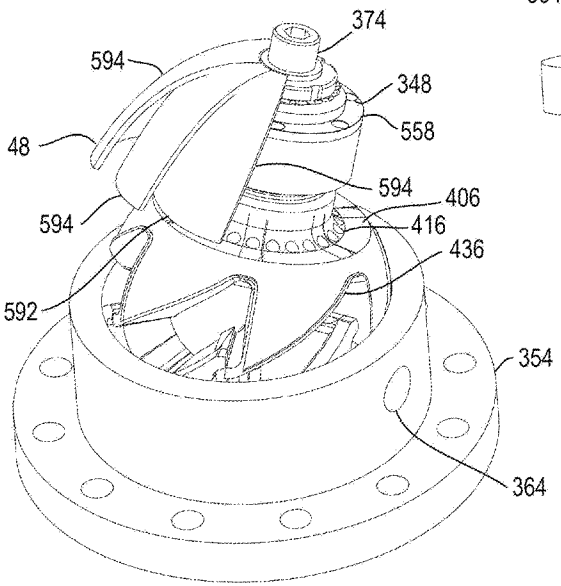
FIG. 88 is a side isometric view of several components shown in FIG. 84.
Figure 85:
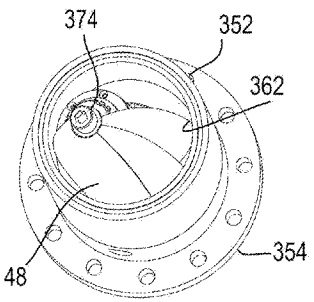
FIG. 85 is a top isometric view of several components shown in FIG. 84.
Figure 86:
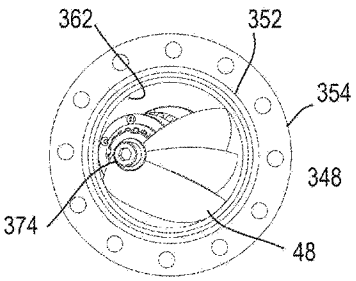
FIG. 86 is a top view of several components shown in FIG. 84.

As the main shaft 370 rotates, the offset shaft 374 precesses about the axis 370 of the main shaft 370. A collar 400 provided about the offset shaft 374 and a plurality of bearings 402/404 may be provided between the collar 400 and the rotor 406 to reduce friction there between. A keeper 412 may be utilized to maintain the bearings 402 in the correct position on the offset shaft 374. A channel 414 may be utilized to hold the keeper 412 in position on the shaft. In one example, lock nut and lock washer (bearing keeper 412) are tightened on a thread (shown as channel 414) located on the outside diameter of collar 400. In this example, the lock nut is tightened down against a sleeve spacer ring. The spacer ring presses against an inner race of the upper taper roller bearing 402. This spacer ring in one example also serves as a sealing surface for an upper rotary seal 556 that may be contained in the annular cavity formed by a small end cap 558. In one example, the end cap 558 is adjacent the lock washer/lock nut (keeper 412). In FIG. 88 are shown voids 348 in the end cap 558 where fasteners (bolts) pass and therefore fasten the end cap 558 to rotor 406. In FIG. 88, some of the voids 348 are obscured by the wings (blade surfaces) 594. These voids 348 may receive fasteners which fasten the end cap 558 to the upper sleeve of the rotor 406. Another keeper 454 may be utilized to maintain bearings 456 and 458 in position relative to the housing 350 and shaft 370. A channel 460 (FIG. 68) may be formed in the shaft 370 to retain the keeper 458 in place. In one example, the channel 460 is an undercut provided adjacent male threads on the outside of the shaft 370. These male threads are provided to thread and tighten the keeper 454 (lock nut, lock washer) on shaft 370. As the lobes 408 between valleys 410 of the rotor 406 engage the lobes 408' between valleys 410' of the stator 392, and as the stator 392 is affixed to the housing, the rotor 406 is therefore substantially prohibited from rotation relative to the housing 350. The rotor 406 therefore experiences nutational movement in relation to the stator 392 as with the previous examples.

Another substantial difference between this example and previous examples is in the porting arrangement. In particular, when used as a pump or compressor, the port 360 in the plate 358, or other portion of the upper housing 352 functions as an inlet port and the fluid flows past the upper portion of the rotor 406 and passes through ports 416 which can also be seen in FIG. 64. A dynamic seal 422 may be provided to reduce or eliminate fluid flow between the ports 416 and the bearings 402/404. The fluid enters chambers provided between the face of the rotor and the opposing face of the stator 392 as the chamber in question increases in volume.

Looking to FIGS. 65-68 it can be seen how the main rotor 370 comprises a spherical surface or ball 418 with features unique to those shown in previous examples. The ball surface 418 comprises a substantially planar surface 420 generally normal to the offset axis 380 and having the surface 384 provided there through. To facilitate porting through the ball surface of 418, cutaway portion 426 is provided in the surface 420 and extended downward to form port surface 424 which allows fluid flow from the ports 416 to an enlarging chamber between the rotor 406 and the stator 392. A manifold is therefore provided in some examples wherein the annular chamber 596 is in communication with the ports 416. This annular chamber 596 in one example is also is in fluid communication with the port surface 424. Annular chamber 596 is perhaps best seen in FIG. 84. A rotary seal 422 may be fit into an annular gap at this position. In one example, as the shaft 370 rotates, groove 426 rotates relative to the (6) lobe chambers. When the groove 438 passes any particular "valley" opposing lobes, the apparatus is allowed to intake fluid therebetween. As the shaft 370 rotates, the volume of the chambers between opposing lobes/valleys decreases, and the apparatus corresponds to a discharge stroke. In some examples, the design reduces or eliminates the necessity for a check valve at the port 360.

As the shaft 370 rotates along with the ball 418, the ports 416 are sequentially allowed fluid communication with chambers between the stator 392 and rotor 406. Likewise, on the opposing circumferential side of the ball 418 is provided an asymmetric port surface 438. Although at the upper edge 440 the port surface 438 is sealed to the inner spherical surface 442 and fluid flow is therefore prohibited to the ports 416 of the rotor 406, the lower surface 444 is aligned with a port channel 428 through rotation of the shaft and the port channel is in fluid communication with ports 430 through the outer spherical surface 446 of the stator 392. As the stator 392 is affixed to the lower housing 354, it can be appreciated that the ports 430 are aligned with or in fluid communication with ports 364 to allow fluid flow through the housing 350.

Figure 64:
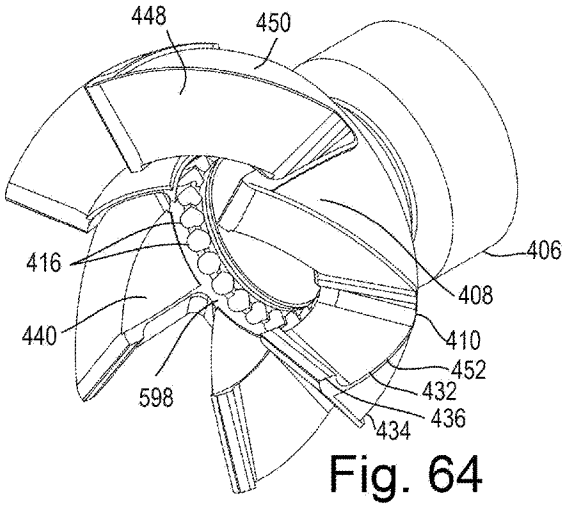
FIG. 64 is a top isometric view of the rotor component shown in FIG. 62.

Looking to FIGS. 63 and 64 it can be appreciated that the axial faces 432 and 432' of the rotor 406 and stator 292 respectively have a significant cutout portion which will not engage the axial face of the opposing surface through nutation. However, at the apex of the teardrop shape scribed by the tip of the opposing lobe 408 of the rotor 406 relative to the stator 292 axial seal surfaces 436/436' are provided for sealing of the adjacent chamber at one short segment of nutation. Due in part to the nature of the port surfaces 424 and 438 rotating with the shaft 370, a novel sealing system can be utilized. In particular, as each upper surface 448 of each lobe 408 provided on the rotor 406 engages a cooperating upper surface 448' on the stator 392 as a rolling seal equivalent to the seal between the surfaces 168 disclosed above it can be appreciated that in a pumping or compressing application, the chambers will reduce in volume and at least at the apex point of nutation, fluid will be generally forced past the port surface 438 in the shaft 370 out through ports 364. Likewise, on the other circumferential side as the volume of the chambers there increase in volume and as the port surface 424 is allowed fluid communication with the ports 416 and 360, it can be appreciated that a pumping or compressing action will be achieved. Additionally, this configuration allows fluid to pass beyond the lobes 408/408' during a significant part of the nutation and will therefore provide a more continuous pumping action and may be achieved in other examples shown here in. Additionally, allowing some fluid to flow past the adjacent lobes 408/408' may significantly reduce backlash.

Another novel feature is shown in reference to the rotor 406. It can be seen how the radially outward surface 450 of the rotor 406 comprises a recessed region 434 to significantly reduce machining tolerances etc. To maintain a seal between the radially outward surface 450 of the rotor 406 and the inner surface 438 of the upper housing component 352 a radially protruding seal surface 452 may be provided which forms a seal either contact or fluid between the rotor 406 and the surface 438 of the upper housing component 352 as well is an extension of the surface 438 in the lower housing component if so provided. In one form, the raised housing seal 452 may also be utilized wherein an abradable coating is provided on the inside spherical surface of the housing 352. In such an application, the housing seal 452 may be formed of a hard metal material so as to more easily abrade the coating in order to produce a tight fitting gap seal with the housing. Such an abradable coating may alternatively, or in combination be applied to the rotor and/or stator (as well as the housing). While such abradable coatings were previously impractical in nutating or rotating positive displacement devices, by utilizing the indexing/power transfer systems disclosed herein, such abradable coatings are practical.

Looking to FIGS. 72-80, another example is disclosed with additional novel components in combination with several components disclosed above. Looking to FIG. 72, it can be seen how a housing 462 is provided which in this example comprises an upper housing 464, an upper median housing 466, a lower median housing 467 and a lower housing 469. Although the fastening mechanism between these components is not shown, it can be appreciated by looking to the previous examples. Alternatively, as with the previous examples, other fastening methods can be utilized such as adhesives, welding, brazing, etc.

Figure 73:
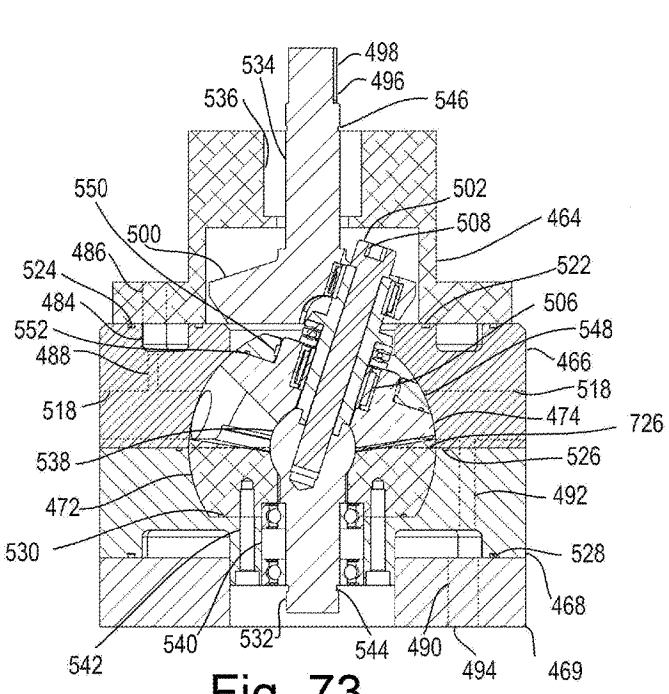
FIG. 73 is a cutaway view taken along line 73-73 of FIG. 72.
Figure 72:
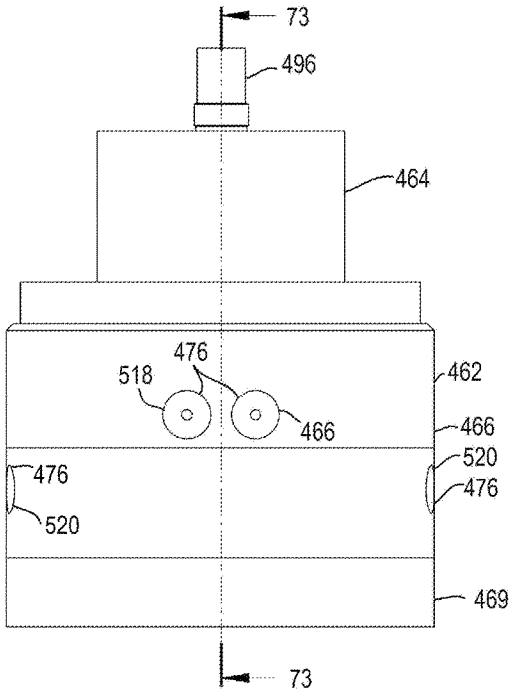
FIG. 72 is a front view of an example of the disclosed apparatus including a housing and shaft.

As with the previous examples, lower ports 520 and upper ports 518 may be provided in fluid communication with chambers 468 and 470 respectively between the stator 472 and the rotor 474. As the rotor 474 and stator 472 are similar in form and function to the rotor and stator shown in FIGS. 4-6, the chambers 468 and 470 provided between the lobes can be understood by reviewing the disclosure above. In one form, check valves 476 may be provided for one-way flow through specific ports, and to provide a breaking pressure. In some instances where specific check valves are referenced in this disclosure, an alphabetic suffix will be utilized to indicate a specific check valve. For example, the check valves are generally labeled 476 but one specific check valve is labeled as check valve 476A shown in FIG. 78. Check valve 476 is specifically referenced again below, and thus a specific label is used. As can be clearly seen in FIGS. 78-80 the check valves utilized herein comprise a fluid flow surface 478 which is in fluid contact with a valve member 480 to allow fluid passed the valve 480 in one direction only. As such, the outer end portion 482 of the check valve 476 may not allow fluid to pass through the port opening into which the valve 476 is fitted. Therefore, as can be seen in FIG. 73, a channel 484 may be ported (in fluid communication) through the housing at 486 and generally provide a common inlet (or outlet) for alternate check valves 476A connected to the fluid channel 484 by way of fluid sub-channel 488. Likewise, a lower fluid channel 490 may connect via fluid sub-channels 492 to alternate check valves 476B. A housing port 494 may be provided with a threaded or other fluid coupling surface for attachment to piping or other apparatus. In this way, a common inlet and common outlets are provided in the housing allowing for easy fluid connectivity.

As can be clearly understood by looking to FIG. 73, there are several similarities between this example and the example shown in FIG. 62. The apparatus comprises a shaft 496 which may include a keyway 498. While the example shown in FIG. 62 is shown as being driven from the bottom (bottom shaft), the example of FIGS. 72-80 is shown driven from the top (top shaft). In some applications, the apparatus of either example could easily be used in a side oriented or inverted position, depending on the application and fluid flow required. The shaft 496 comprises or is fixed to an precession cam 500 with an offset shaft 502 engaged therein with bearing 504 positioned between the offset shaft 502 and the precession cam 500 so as to allow free rotation of the offset shaft 502 relative to the precession cam 500. As can be more easily seen in FIG. 79, the offset shaft 502 comprises a non-cylindrical surface 508 which functions in the same way as the non-cylindrical surface 388 previously discussed. The offset shaft 502 passes through a rotor 474 with a bearing 506 positioned there between to allow free rotation of the offset shaft 502 relative to the rotor 474. In this way, the rotor 474 is allowed to nutate relative to the stator 472. As with the example of FIG. 62, lobes 508 and valleys 510 of opposing rotor 474 and stator 472 prohibit substantial rotation of the rotor 474 relative to the stator 472. In one application, the check valves 476A provide for fluid to enter the chambers 470 between the valley 510A of the rotor 474 and the lobe 508'A of the stator 472. As can be seen in FIG. 78 seal points 512, 514, and 516 are formed at this position of nutation on either circumferential side of the chamber 468. As discussed relative to FIGS. 30-50 in combination with a review of U.S. Pat. No. 6,705,161 these seal points and the effect they have on fluid flow can be understood, which describes quite well this particular example of a lobe/valley combination and the seal points there between with slight modifications.

Figure 77:
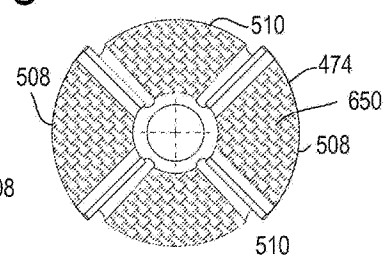
FIG. 77 is a top view of the rotor component shown in FIG. 74.
Figure 78:
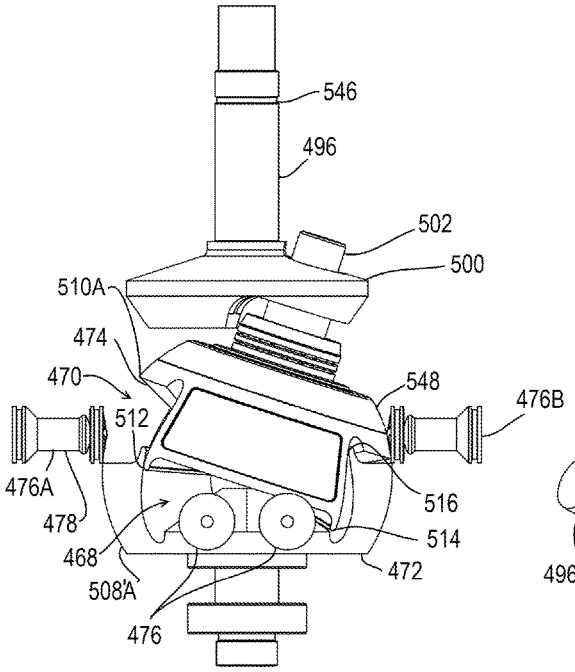
FIG. 78 is a side view of the rotor assembly shown in FIG. 73.
Figure 79:
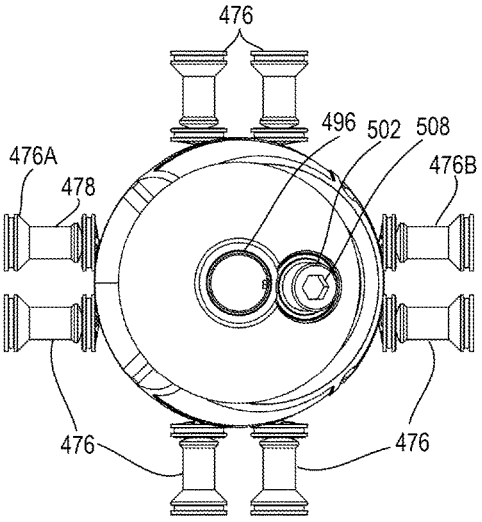
FIG. 79 is a top view of the rotor assembly shown in FIG. 78.
Figure 80:
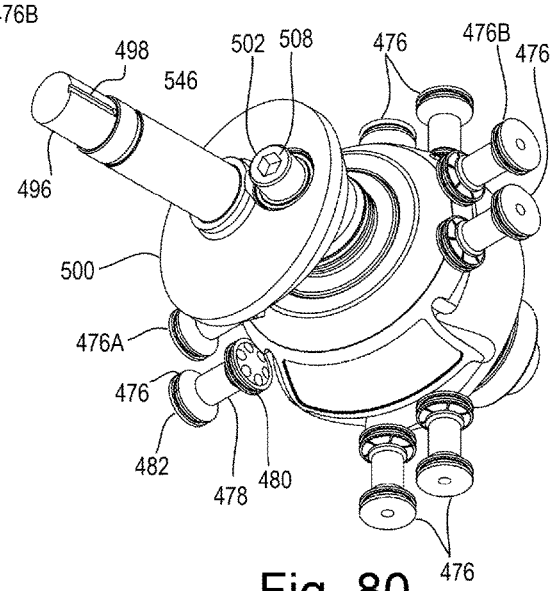
FIG. 80 is a side isometric view of the rotor assembly shown in FIG. 78.

FIG. 77 also shows one example of a turbulence generating surface 650 which may be applied to the non-sealing surfaces of the rotor and or stator to generate localized vortexes on the surface thereof. Such surfaces reduce fluid flow hindrance, and reduce contaminate build in some applications. One disclosure of such turbulence surfaces is presented in U.S. Pat. No. 4,907,765.

Looking to FIG. 73, it can be appreciated that a system of static and dynamic seals similar to those used in the previous examples may be used. In particular, static seals of 522 and 524 are utilized on either radially outward edge of the fluid channel 484 to reduce or eliminate fluid flow between the upper housing 464 and the upper median housing 466. Likewise, a static seal 526 may be utilized between the upper median housing 466 and the lower median housing 467. A similar static seal 528 may be utilized between the lower median housing 467 and the lower housing 469. A static seal 530 may also be utilized between the stator 472 and the lower median housing 467. Additionally, dynamic seals may be provided between the shaft 496 and the upper housing 464 as well as between the lower shaft 532 and the lower housing 470. Dynamic (shaft) seals may also be utilized between the stator 472 and the shaft 544. A keeper (lock nut and lock washer) may be utilized, and may engage channel 544 of FIG. 73. The channel 544 in one example represents threads on the outside diameter of the lower shaft 532 for attachment of the bearing keeper. Looking to the top portion of FIG. 73, it can be seen that the shaft 496 comprises a bearing surface 534 adjacent and offset from a bearing surface 536 on the upper housing 464. A bearing similar to the bearing 404 shown in FIG. 62 may be utilized to reduce friction between these surfaces.

Looking to the lower portion of FIG. 73 it can be seen how the ball surface 538 at the center of the rotor 474 and stator 472 has a lower shaft 532 extending there from through the bottom portion of the lower housing 469. A bearing 540 may be provided at this location to reduce frictional losses there between. Also, fasteners 542 can be seen of equivalent function to the fasteners 146 of FIG. 10 to maintain position of the stator 472 relative to the housing 462. A channel/thread 544 may be provided in the lower portion of the lower shaft of 532 for attachment of a keeper to maintain the bearing and position similar to the channel/thread 546 in the upper portion of the shaft 496. In one form, the lower shaft 532 may be driven in conjunction with the shaft 496 to increase available port to the rotor 474 or may alternatively drive a secondary component such as a second apparatus such as a second pump, compressor, or expander, fitted there below and attached to be driven simultaneously with the apparatus shown in FIG. 73.

One additional novel feature of FIG. 73 is shown in the dynamic seal component 548 which is fitted to the upper portion of the rotor 474. The dynamic seal component 548 of one example forms a seal between the rotor 474 and the inner spherical surface of the upper housing 464. Static seals 550 and 552 may be utilized between the rotor 474 and the dynamic seal component 548 to reduce or prohibit fluid flow there between.

As with the examples described above, this example may utilize a recessed portion 554 on the radially outward surface of the rotor and a radially protruding sealing edge 556. These are similar in function to the surface 434 and seal 436 described above.

Figure 81:
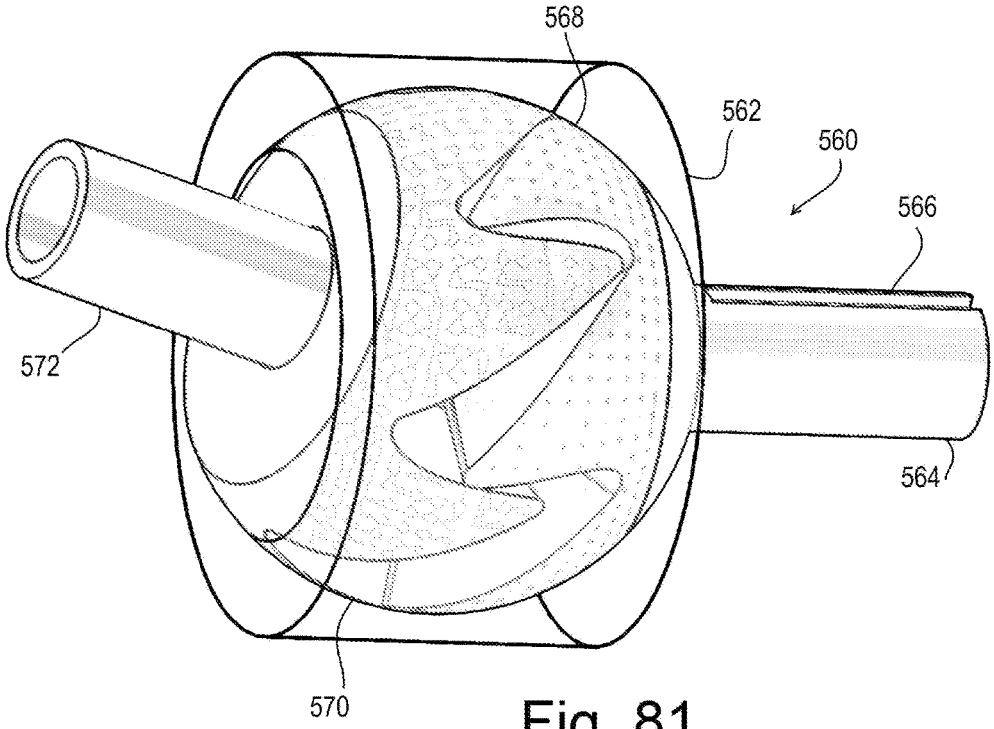
FIG. 81 is a side isometric view of a rotor assembly and partial housing.
Figure 82:
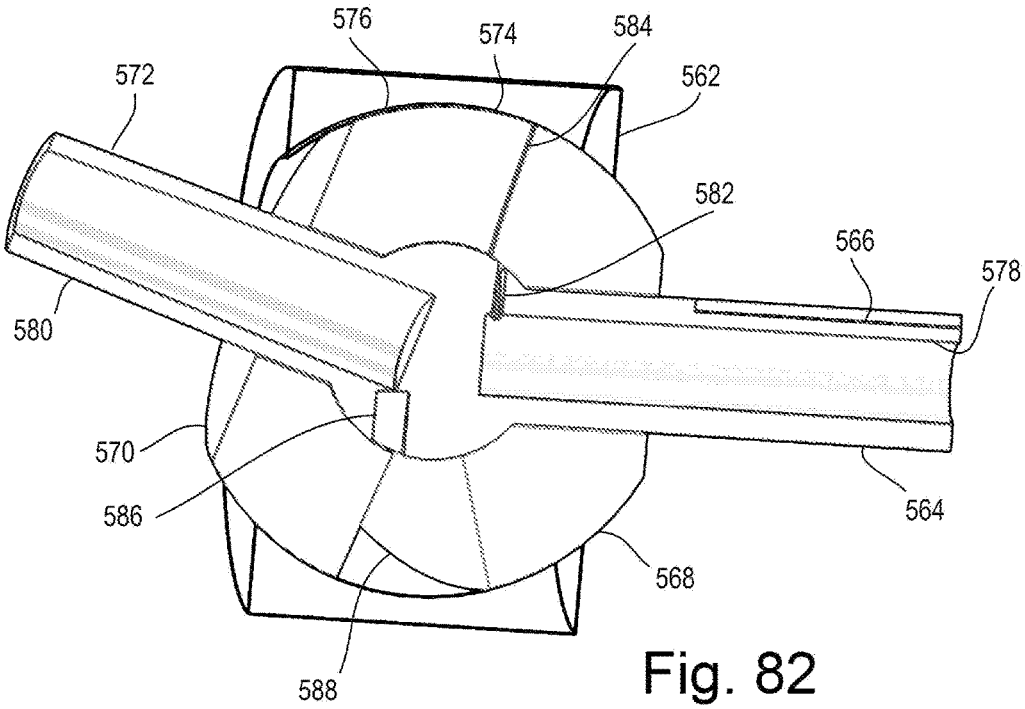
FIG. 82 is a cutaway view of FIG. 81.
Figure 83:
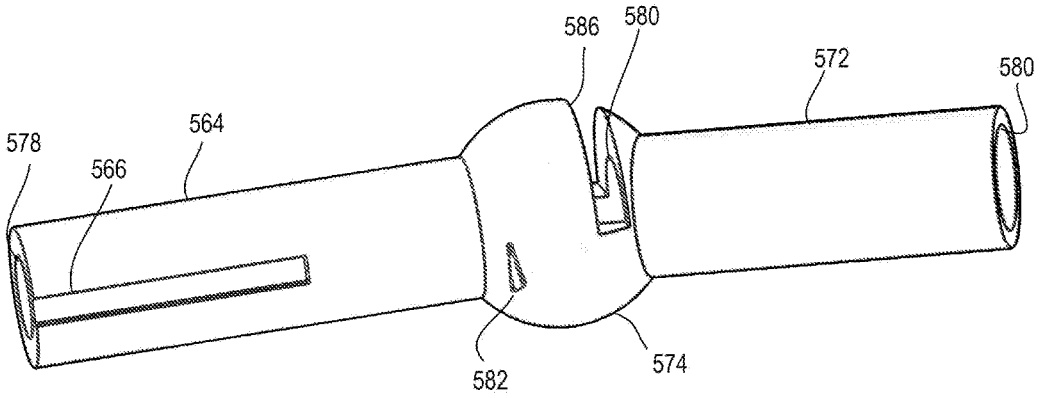
FIG. 83 shows the shafts and spherical surfaces of the inner components shown in FIG. 82.
Figure 84:
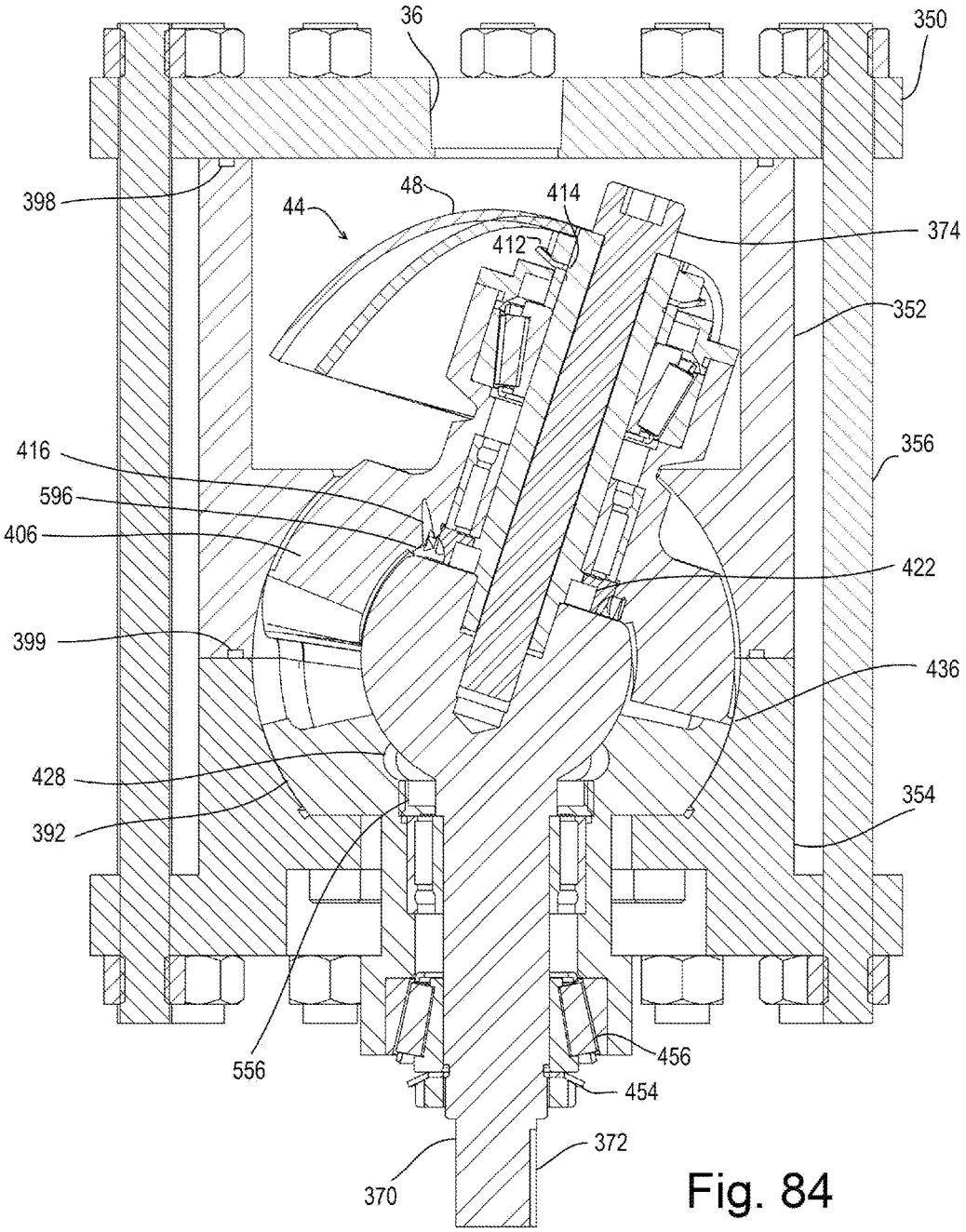
FIG. 84 is a side cutaway view of an example of the disclosed apparatus including a housing and shaft.
Figure 89:
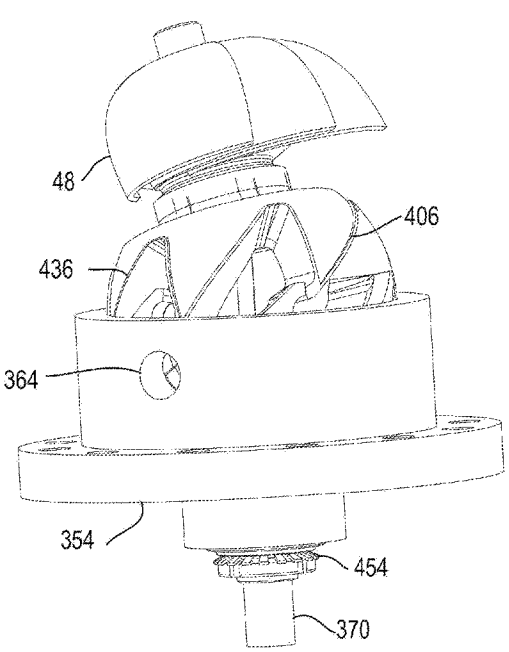
FIG. 89 is another side isometric view of several components shown in FIG. 84, from a different angle from that shown in FIG. 88.
Figure 87:
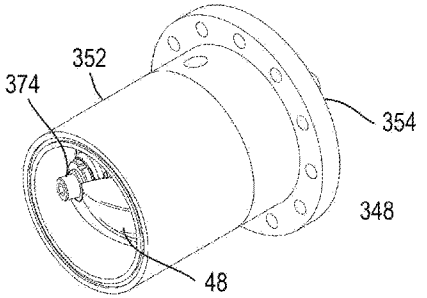
FIG. 87 is a side isometric view of several components shown in FIG. 84.

Looking to FIGS. 81-83 are shown novel components which can be combined with the examples shown above or those disclosed in applicants other inventions. In this example 560, a housing 562 is shown in a highly schematic manner. A shaft 564 may be provided with a keyway 566 for attachment to other apparatuses as previously disclosed. The shaft 564 is shown attached to a rotor 568 having lobes and valleys which engage opposing lobes and valleys on a rotor/stator 570. A second shaft 572 is attached to the rotor/stator 570. Each of the rotors 568 and 570 comprise a spherical outer surface 574 to engage a spherical inner surface 576 of the housing 562. The novel feature shown herein is that the shafts 564 and 572 are hollow as comprising an inner surface 578 and 580 respectively through the length of the shaft 564/572. As shown, a fluid channel 582 may extend between the fluid channel surface 578 of the shaft 564 towards a chamber 584 between the lobes and valleys of the rotors 568/570 which at the position shown in FIG. 82 is at a minimum volume position. Likewise, the fluid channel surface 580 extends towards a fluid channel 586 extending into a chamber 588 between the lobes and the valleys of the rotors 568/570 as shown in FIG. 82 at a maximum volume position. It can therefore be understood that the fluid channels may comprise analysts and outlets provided through the shafts 564/572.

Looking to FIG. 83 the shafts and spherical surface 574 can be seen with the housing 562 removed. Here, it can be appreciated that in this example as the channels 582 and 586 are provided between the rotor 568 and rotor 570 at the maximum volume position the channels are larger in cross section than they are at the minimum volume position. Looking to FIG. 83, it can be seen that the channel 586 is substantially larger than the channel 582. This gap differential can also be seen in FIG. 82.

As previously discussed, the example 590 shown in FIGS. 84-89 utilizes many of the same components as previously discussed relative to FIGS. 61-71. In addition, this example 590 uses a nutating booster pump 44 previously mentioned but shown in detail herein. As can be appreciated, the apparatus utilizes a plurality of arcuate blades 48 which in this example are attached to an upper end of the offset shaft 400 and retained by bolt 374.

This example of these blades 48 are shown as arcuate members having a very small portion at the shaft 374, they have a relatively large circumferential edge 592. In addition, while three cooperating blade surfaces 594 are shown, one, two, or more than three blade surfaces 594 could alternatively be used. Likewise, the blades may not be arcuate but may have some other shape which generally directs fluid from the port 360 downward toward the ports 416 to function as a booster pump. It can also be appreciated that while the rotor 406 nutates about the stator 392 as the blades 48 are substantially rigidly attached to the offset shaft 374 and as the offset shaft 374 is substantially rigidly fixed to the shaft 370 the effective or relative motion of the blades 48 relative to the housing 350 are a rotating motion rather than a wobbling or nutating motion.

Figure 90:
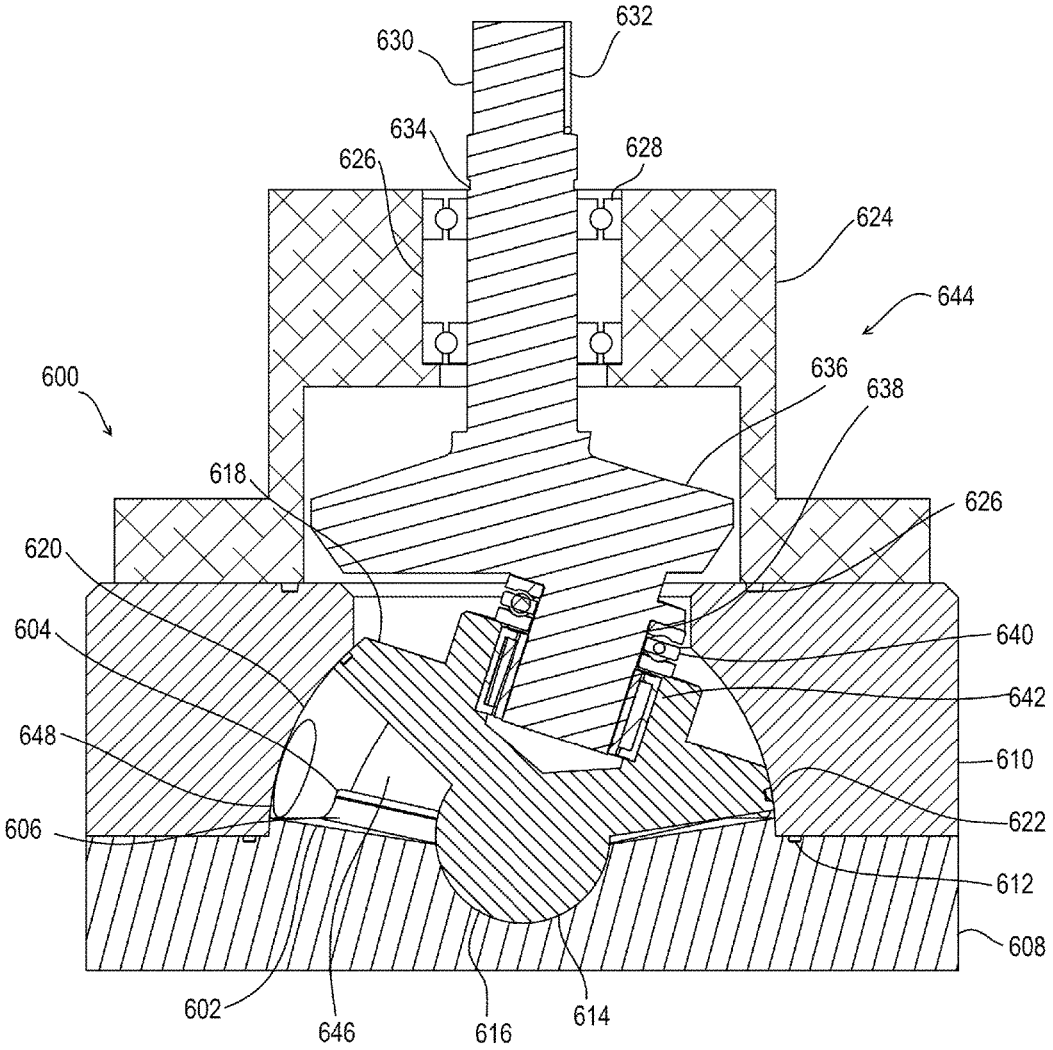
FIG. 90 is a cutaway view of another example of the disclosed apparatus.

FIG. 90 shows another example wherein the stator face 602 having lobes 604 and valleys 606 is formed as a unitary structure with the lower housing 608. The lobes and valleys on the stator interact with lobes and valleys on the rotor in a manner as described above in several examples. This interaction is substantially the same as described above, and therefore need not be repeated here.

The lower housing in this example has no opening in the bottom thereof. In one example a female spherical surface 614 is provided for engagement with a male spherical ball 616 of the rotor 618. The lower housing 608 in this example is positioned adjacent and fastened to a median housing 610 with a static seal 612 there between. The median housing 610 comprises a female spherical surface 620 which is in contact with a radially outward face of the rotor. In one example, a dynamic seal 622 may be provided to substantially prohibit fluid flow between the radially outward surface of the rotor and the surface 620 of the median housing 610

In the example shown, an upper housing 624 is attached to the median housing 610. In this example, a static seal 626 is provided there between to prohibit fluid flow between the upper housing 624 and the median housing 610. In this example, the upper housing 624 has a surface 626 defining an opening in the upper portion thereof. A bearing 628 may be press fit into the surface 626 and a shaft 630 engages the inner surface of the bearing 628 to reduce friction between the shaft 630 and the upper housing 624 as the shaft 630 rotates. As with previous examples, a keyway 632 may be provided for rotation of the shaft 630 by a motor, engine, or similar driving device. A channel 634 may also be provided for attachment of a bearing keeper as shown in previous examples. As with previous examples, the channel 634 may be representative of a threaded surface such that the keeper comprises a lock nut etc.

In the example shown in FIG. 90, the shaft 630 comprises a precession cam 636 thereupon with an offset shaft 638 extending therefrom toward an into the rotor 618. As with previous examples, bearings 640 and 642 may be provided to reduce frictional forces between the offset shaft 638 and the rotor 618. While in the example shown, the shaft 630, precession cam 636, and offset shaft 638 are formed as a unitary structure, it is also conceived that these components could be formed independently.

Generally speaking, the shaft 630, offset shaft 638 and rotor 618 function quite similarly to the embodiment shown in FIG. 73. One substantial difference between these examples however, is in the removal of the lower shaft 532 shown in FIG. 73. By removing the lower shaft 532 the number of gaps (especially between moving and stationary components) which must be sealed to reduce fluid flow downward out of the apparatus are substantially reduced. In addition, the overall apparatus is substantially simpler in manufacture by reducing the number of moving components.

As can be appreciated following a thorough discussion of the function of the apparatus especially in reference to FIG. 73, it can be appreciated that as the shaft 630 rotates, the precession cam 636 will rotate there with, along with the offset shaft 638. Engagement of the lobes 604 and valleys 606 of the stator face 602 with lobes and valleys provided on the rotor 618 substantially prohibits rotation of the rotor 618 relative to the stator face 602, and therefore substantially prohibits rotation of the rotor 618 relative to the housing 644. Therefore, the rotor 618 experiences a nutating motion relative to the stator face 602. Thus, the chamber 646 increases and decreases in volume thus, "pumping" fluid through ports 648 provided through the housing 644 such as through the median housing 610. As with previous examples fluidic connections including for example check valves may be utilized at the ports 648.

Other advantages of this design include: a highly simplified architecture for a nutating device 600 with fewer seals, fewer bearings, easy alignment of assembly by the centralization of the ball 616, integrated with rotor 618, fewer parts and less leakage due to the integrated ball 616. The architecture could be used with different lobe shapes such as the sawtooth shape shown here as potentially the simplest design of those shown. The lobe/valley shapes as shown above in FIGS. 16-20. Porting arrangements similar to this porting arrangement are shown in FIGS. 8-10.

Figure 95:
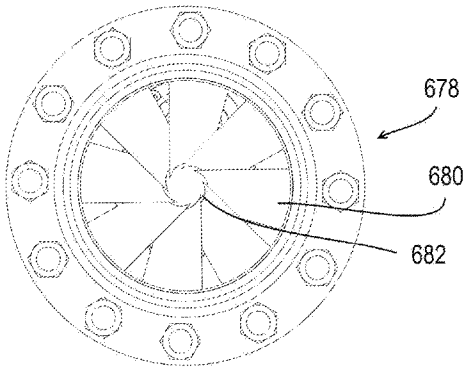
FIG. 95 is a top view of the example shown in FIG. 94.
Figure 96:
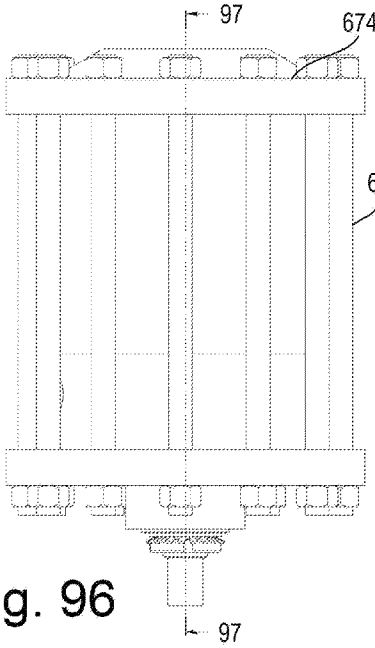
FIG. 96 is a side view of the example shown in FIG. 95.
Figure 97:
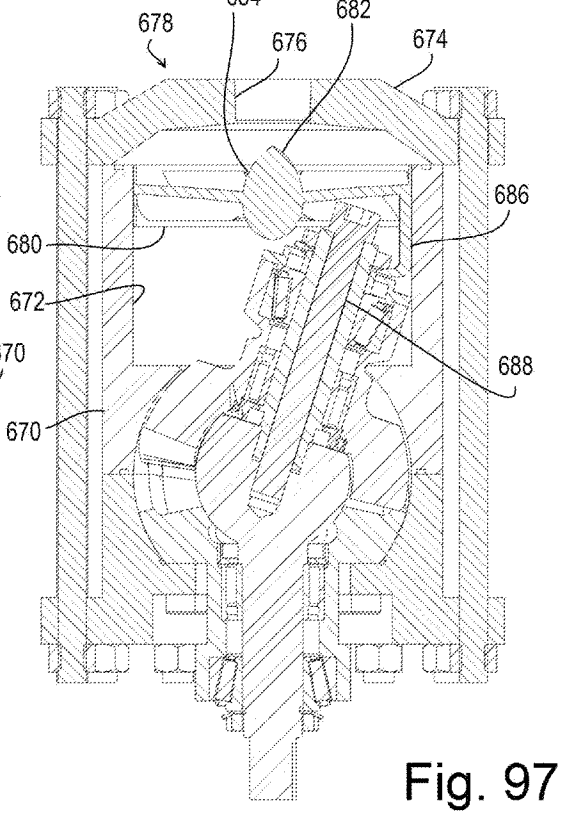
FIG. 97 is a cutaway view taken along line 97-97 of FIG. 96.
Figure 94:
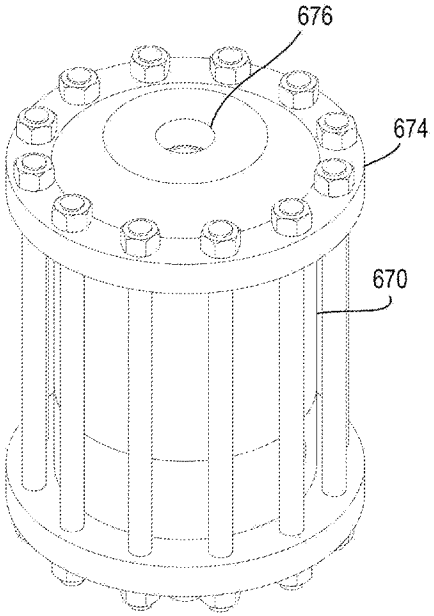
FIG. 94 is an isometric view of the disclosed apparatus with another example of a booster pump.

Looking to FIGS. 94-97, an example is shown substantially similar to the example shown in FIGS. 61-62. The components of the stator, a rotor, upper housing, and lower housing are substantially the same as those shown previously and described relative to FIGS. 61 and 62 and therefore explanation of these features will not be repeated. It can be seen that the apparatus utilizes an outer housing 670 forming an inner chamber 672 therein. The top plate 674 includes a surface defining an inlet 676 there through providing access to the inner chamber 672. While the booster pump example shown in FIG. 84 generally comprises a plurality of blades 48 attached to the offset shaft 374 the booster pump 678 shown in FIGS. 95 and 97 comprises a plurality of more linear blades 680. In this example, the blades 680 are attached to a central feature 682 providing rigidity and in one form a hydrodynamic surface 684 similar to a pointed egg which reduces inlet forces of the fluid entering through the inlet 676 into the inner chamber 672. As can be understood a downward projecting portion 686 may be provided between the blades 680 or a portion thereof and the offset shaft 688. Remembering that the offset shaft is fixed to the main shaft 690 it can be appreciated that the booster pump 678 will rotate about the axis of the main shaft 690 within the inner chamber 672. In one form, and opening or void will be provided through the blades 682 allow access to the non-cylindrical portion of the offset shaft 688 for removal or assembly. FIG. 95 shows the apparatus with the top plate removed to show the components (booster pump) within the inner chamber 672.

Figure 98:
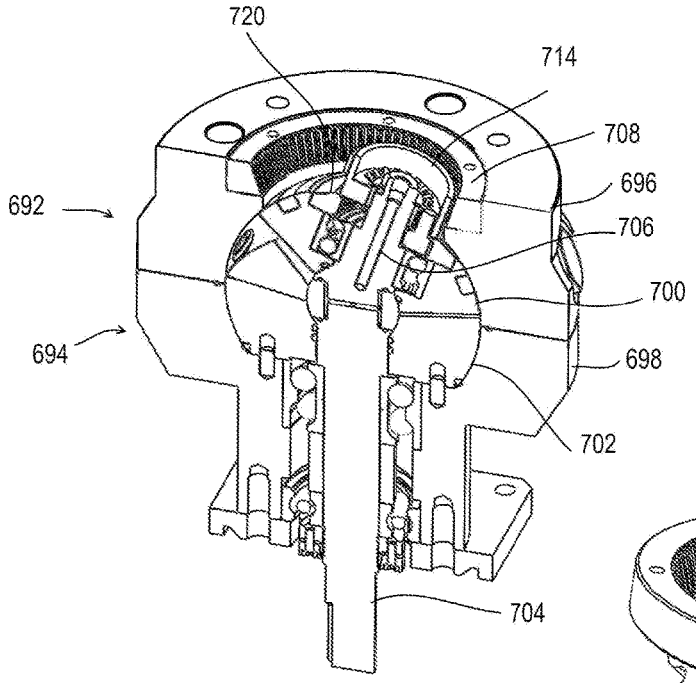
FIG. 98 is an isometric cutaway view of an example incorporating a planetary or epicentric gear.
Figure 99:
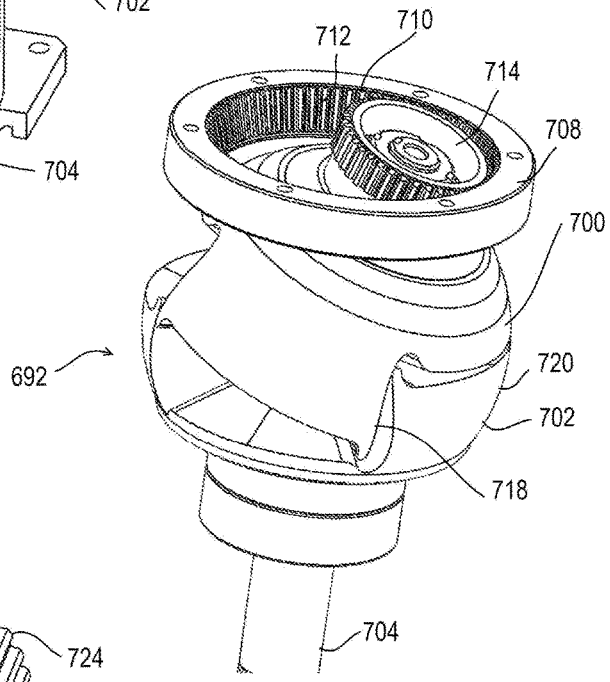
FIG. 99 is an isometric view of several internal components of the example shown in FIG. 98.
Figure 100:
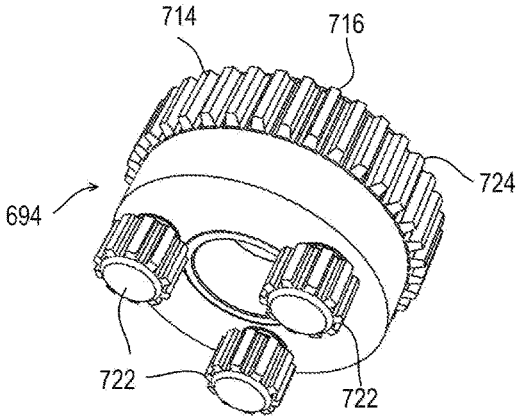
FIG. 100 is an isometric view of several components of the example shown in FIG. 99.

Looking to FIGS. 98-100 is shown one example 692 utilizing a planetary or epicyclic gear assembly 694. As shown, an upper housing 696 and lower housing 698 are provided for housing of the rotor 700 and stator 702. The rotor is driven (nutated) in this example by a main shaft 704. While this example shows a bent shaft embodiment having an offset shaft 706 attached to the main shaft 704, other examples shown above may also be incorporated with the planetary gear assembly 694, or a variant thereof. In the example shown, a fixed ring gear 708 having teeth 710 and grooves 712 may be bolted or otherwise fastened to the upper housing 696. A planet gear carrier 714 may include an idler gear 716 with teeth and grooves thereupon to engage the teeth and grooves of the fixed ring gear 708.

Looking to FIG. 100 it can be seen that the planet gear carrier 714 comprises the idler 716 and an epicyclic planet gear cluster 724. The inner workings of the planetary gear cluster 724 within the carrier 714 are not shown, but are well-known to one of ordinary skill the art. A plurality of planet gears 722 protrude from the bottom portion of the carrier 716 and generally engage an annular ring gear 720 fixed to the rotor 700.

By utilizing such a planetary or epicyclic gear assembly, the contact surfaces between the lobes 718 of the rotor 700 and the lobes 720 of the stator 702 may be reduced or eliminated to reduce wear, provide a sealing gap or fluid gap to avoid cogging.

The fluid flow apparatus as recited herein may be arranged wherein the housing comprises: a first portion and a second portion fixedly attached to the first portion; wherein each of the first and the second portions each comprise an inner surface forming the frusta spherical inner surface of the housing; and wherein the first portion and second portion meet at the equator 726 of the frusta spherical inner surface.

The device may further comprise movable apex seals 728 that are either spring loaded or pressure activated and positioned at the apex or near the apexes of the rotor and/or stator lobes.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A fluid flow apparatus comprising:

a. a housing having a frusta spherical inner surface;

b. wherein the housing is fixed in space;

c. a fixed stator having a center axis disposed along its length and a front face comprising lobes and valleys;

d. the fixed stator being fixedly attached to the housing;

e. a rotor received in the housing and having an axis disposed along its length, the rotor including a bearing disposed therein, a front face comprising lobes and valleys, and a frusta spherical radially outward surface;

f. wherein the rotor nutates about the fixed stator;

g. wherein the center axis of the fixed stator intersects the axis of the rotor;

h. wherein the center axis of the fixed stator is offset from the axis of the rotor by an alpha ($\alpha$) angle;

i. a shaft received through the housing and passing into the rotor and passing through the bearing, the shaft in communication with the rotor and the bearing;

j. wherein the rotor, absent engagement with the fixed stator, is freely rotatable about the shaft via the rotor's bearing;

k. wherein in the presence of engagement with the fixed stator, the lobes and valleys of the rotor interoperate with the lobes and valleys of the fixed stator prohibiting the free rotation of the rotor about the shaft; and l. wherein the lobes and valleys of the fixed stator are in fluid tight seal to the lobes and valleys of the rotor at least at two locations during the interoperation as the rotor nutates about the fixed stator.

2. The fluid flow apparatus as recited in claim 1 wherein the number of lobes on the rotor are equal to the number of lobes on the fixed stator such that net rotation of the rotor relative to the fixed stator is not permitted.

3. The fluid flow apparatus as recited in claim 1 wherein the alpha ($\alpha$) angle is between three (3) and forty-five (45) degrees.

4. The fluid flow apparatus as recited in claim 1 wherein each of the fixed stator and the rotor comprise an even number of lobes.

5. The fluid flow apparatus as recited in claim 1 wherein the lobes of each of the rotor and the fixed stator comprise a leading surface comprising a radial projection of a spherical involute.

6. The fluid flow apparatus as recited in claim 1 wherein the lobes of each of the fixed stator and the rotor comprise a leading surface comprising a spiral spherical projection of a spherical involute.

7. The fluid flow apparatus as recited in claim 1 wherein the lobes of each of the rotor and fixed stator comprise a following surface comprising a radial projection of a teardrop curve.

8. The fluid flow apparatus as recited in claim 1 wherein the rotor is rotatably attached to a shaft passing through the housing, transferring rotational torque with the rotor; wherein the shaft passes through and rotates relative to the fixed stator.

9. The fluid flow apparatus as recited in claim 1 comprising a booster pump fluidly upstream of the rotor and coupled to the shaft so as to rotate therewith.

10. The fluid flow apparatus as recited in claim 9 wherein the booster pump comprises a plurality of blades attached to the shaft, wherein the axis of the shaft is offset from a center of rotation of the plurality of blades.

11. The fluid flow apparatus as recited in claim 1 wherein the shaft comprises:

a. a first portion; and b. a second portion removably attached to the first section at the alpha ($\alpha$) angle to the first section.

12. The fluid flow apparatus as recited in claim 1 further comprising:

a. a precession cam fixed to the shaft so as to rotate there with;

b. a precession shaft attached to the precession cam so as to rotate about the shaft at a precession angle thereto;

c. wherein the precession shaft is attached to the rotor coaxial with the axis of the rotor; and d. wherein the precession shaft transfers rotational torque to the rotor.

13. The fluid flow apparatus as recited in claim 12 wherein the precession angle equals the alpha ($\alpha$) angle.

14. The fluid flow apparatus as recited in claim 12 wherein the precession cam and precession shaft are counterbalanced.

15. The fluid flow apparatus as recited in claim 1 wherein the housing comprises:

a. a first housing portion, b. a second housing portion fixedly attached to the first housing portion;

c. wherein each of the first and the second portions each comprise an inner surface forming the frusta spherical inner surface of the housing; and d. wherein the first portion and second portion meet at the equator of the fixed stator.

16. The fluid flow apparatus as recited in claim 1 further comprising:

a. surfaces defining inlet ports through the housing;

b. surfaces defining outlet ports through the housing;

c. wherein precession of the rotor relative to the fixed stator forms a region of maximum volume and a region of minimum volume between the rotor and the fixed stator; and d. wherein the inlet ports and outlet ports are in fluid communication with chambers formed between the fixed stator and the rotor.

17. The fluid flow apparatus as recited in claim 16 wherein the inlet ports and/or outlet ports exit the housing substantially parallel to the rotational axis of the shaft.

18. The fluid flow apparatus as recited in claim 16 wherein the inlet ports are angled to direct a fluid flow to non-contacting portions of the lobes and/or valleys to remove precipitating debris therefrom.

19. The fluid flow apparatus as recited in claim 1, further comprising turbulence generating surfaces on non-inter contacting portions of the lobes of the rotor and/or fixed stator.

20. The fluid flow apparatus as recited in claim 1 comprising a rolling seal on the non-axial face of each lobe.

21. The fluid flow apparatus as recited in claim 1 comprising a sliding seal on the axial faces of each lobe for self-cleaning.

22. The fluid flow apparatus as recited in claim 1 comprising a booster pump fluidly upstream of the rotor.

23. The fluid flow apparatus as recited in claim 1 further comprising a substantially spherical ball positioned at the radial center of the rotor and the fixed stator; wherein fluid porting is provided through cutout regions of the outer surface of the center ball.

24. The fluid flow apparatus as recited in claim 23 wherein the center ball is ported for fluid to pass in combination with the rotor, where the port will communicate high pressure gas between the rotors and a high pressure fluid reservoir is in fluid communication through the axis of the shaft, where the rotation of the shaft with respect to the fixed rotor allows the port to be sealed off as a rotor lobe blocks the port.

25. The fluid flow apparatus as recited in claim 23 wherein the fixed stator is manifolded at the center ball.

26. The fluid flow apparatus as recited in claim 1 further comprising movable apex seals that are either spring loaded or pressure activated and positioned at the apex or near the apexes of the rotor lobes and/or the fixed stator lobes.

27. The fluid flow apparatus as recited in claim 1 wherein seal surfaces of the rotor and the fixed stator are identical.

28. The fluid flow apparatus as recited in claim 1 wherein lobes of the rotor are of a different circumferential width than the lobes of the fixed stator.

29. The fluid flow apparatus as recited in claim 1 wherein the rotor is pressure balanced so as to balance against the fluid pressure within chambers bounded by the lobes and the valleys of the rotor/fixed stator.

30. The fluid flow apparatus as recited in claim 1 where vibration due to the nutation motion is dynamically or statically balanced by adding or removing counterweights, strategically to reduce or eliminate such imbalance.

31. The fluid flow apparatus as recited in claim 1 further comprising a protruding lip that extends from each mound and from an exterior of mound spherical surfaces of the rotor or of the fixed stator, such that the protruding lip can wear-in, made of the same material as the lobes.

32. The fluid flow apparatus as recited in claim 1 wherein the rotor and the fixed stator comprise an even number of lobes resulting in reduced pulsation.

33. A fluid flow apparatus comprising:

a. a housing having a frusta spherical inner surface;

b. wherein the housing is fixed in space;

c. a stator having a center axis, and a front face comprising lobes and valleys;

d. the stator fixed to the housing;

e. a rotor having an axis, a front face comprising lobes and valleys, and a frusta spherical radially outward surface;

f. wherein the rotor nutates about the stator;

g. wherein the axis of the stator intersects the axis of the rotor;

h. wherein the axis of the stator is offset from the axis of the rotor by an alpha ($\alpha$) angle;

i. the rotor configured to interoperate with the lobes and valleys of the stator; and j. wherein the lobes and valleys of the stator are substantially in fluid tight seal to the lobes and valleys of the rotor at least at two points during precession of the rotor;

k. wherein the rotor is rotatably attached to a shaft passing through the housing and transferring rotational torque with the rotor;

l. wherein the shaft passes through and rotates relative to the stator;

m. wherein the shaft comprises a first portion adjacent to the stator and coaxial thereto;

n. the shaft further comprising a second portion adjacent to the rotor and coaxial thereto; and o. wherein the first portion of the shaft forms an angle relative to the second portion equal to the alpha angle.

34. A nutating positive displacement device comprising:

a. a stator having lobes, valleys, and an axis;

b. a rotor with equal number of lobes and valleys as the stator; and a substantially spherical radially outward surface;

c. wherein the rotor follows a precessing motion with respect to the stator such that a central axis of the rotor is at a constant angle to the axis of the stator; and the rotor's axis rotates about the stator axis;

d. wherein the contoured seal faces of the lobes and the valleys of the stator and the rotor are formed in such a way as to provide a predetermined fluid seal gap between the faces to provide sealing;

e. wherein the shaft further comprises a precession cam providing a constant angle of precession of the rotor about the stator; and f. wherein the constant angle of precession and motion of the rotor are determined by a series of bearings, one or more of which are mounted at an angle on the precession cam, the precession cam rotating about an axis that intersects the center axis of the stator.

35. The nutating positive displacement device as recited in claim 34 wherein:

a. the rotor is housed within an assembly shroud that has a spherically concave inner surface which engages the spherical outer surfaces of the stator and rotor with a gap between said surfaces; and b. the shroud being fixed with respect to the rotor and providing a static seal between the shroud and rotor component, and the shroud moves in a precessing motion along with the rotor.

36. The nutating positive displacement device as recited in claim 35 further comprising dynamic sealing members positioned between the inside spherical surface of the shroud and the outside spherical surface of the rotor and/or the stator.

37. The nutating positive displacement device as recited in claim 35 wherein the shroud is of a short enough length such that the valleys of the rotor are exposed at the maximum volume position so as to act as an intake port, and subsequently discharge porting may occur by porting through the center ball/rotating shaft such that the discharge porting is arranged such that as the rotor nutates at the maximum volume position the discharge porting is closed but at the minimum volume positions the discharge porting is open to the discharge port.

38. The nutating positive displacement device as recited in claim 35 wherein:

a. the shroud is a sealed chamber;

b. a chamber within which the rotor nutates is flooded with inlet fluid, and c. the shaft further comprises seal blocks formed in a center ball, and d. wherein inlet and discharge porting is provided in opposite directions relative to the shaft.

* * * * *